US005382496A

United States Patent [19]

Sakai et al.

[11] Patent Number: 5,382,496

[45] Date of Patent: Jan. 17, 1995

[54] SILVER HALIDE LIGHT-SENSITIVE MATERIAL AND A METHOD FOR FORMING IMAGE USING THE SAME

[75] Inventors: Minoru Sakai; Kazunobu Katoh; Kiyoshi Morimoto, all of Kanagawa, Japan

[73] Assignee: Fuji Photo Film Co., Ltd., Kanagawa, Japan

[21] Appl. No.: 162,843

[22] Filed: Dec. 7, 1993

[30] Foreign Application Priority Data

Dec. 25, 1992 [JP] Japan ..... 4-357688

[51] Int. Cl.[6] ..... G03C 1/06

[52] U.S. Cl. ..... 430/264; 430/267; 430/598; 430/949; 430/606; 430/608; 430/613; 430/434

[58] Field of Search ..... 430/264, 267, 598, 949, 430/606, 608, 613, 434

[56] References Cited

U.S. PATENT DOCUMENTS

| | | | |
|---|---|---|---|
| 3,984,243 | 10/1976 | Shimamura et al. | 430/267 |
| 4,135,931 | 1/1979 | Yoneyama et al. | 430/267 |
| 4,272,606 | 6/1981 | Mifume et al. | 430/264 |
| 4,552,837 | 11/1985 | Okazaki et al. | 430/613 |
| 4,847,180 | 7/1989 | Miyata et al. | 430/264 |
| 5,139,920 | 8/1992 | Hayashi et al. | 430/264 |
| 5,145,765 | 9/1992 | Okamura et al. | 430/264 |

*Primary Examiner*—Thomas R. Neville
*Attorney, Agent, or Firm*—Sughrue, Mion, Zinn, Macpeak & Seas

[57] ABSTRACT

There is disclosed a silver halide light-sensitive material and a method for forming image using thereof, in which a high contrast negative image useful in a photographic plate making process can be obtained in a processing solution with a pH lower than 11.0. The silver halide light-sensitive material comprises a support having provided thereon at least one silver halide emulsion layer and containing a hydrazine derivative in the above emulsion layer and/or a layer adjacent thereto. At least one compound represented by the following Formula (I) or (II) is contained in the above emulsion layer and/or a layer adjacent thereto:

(I)

(II)

wherein A represents an organic group necessary for completing a hereto ring; B and C each represents a group constituted of one or more members selected from the group consisting of an alkylene group, an arylene group, an alkenylene group, —$SO_2$—, —SO—, —O—, —S—, and —N($R_5$)—, where $R_5$ represents an alkyl group, an aryl group, or a hydrogen atom; $R_1$ and $R_2$ each represents an alkyl group; $R_3$ and $R_4$ each represents a substituent; and X represents an anion group, provided that X is not necessary when the compound is an inner salt.

24 Claims, 1 Drawing Sheet

SILVER HALIDE LIGHT-SENSITIVE MATERIAL AND A METHOD FOR FORMING IMAGE USING THE SAME

FIELD OF THE INVENTION

The present invention relates to a silver halide light-sensitive material and a method for forming images using thereof, specifically to a silver halide light-sensitive material in which a high contrast negative image useful in a photographic plate making process can be obtained in a processing solution with pH lower than 11.0.

BACKGROUND OF THE INVENTION

Various additives are proposed for the purpose of improving the photographic characteristics (sensitivity, fog and rapid development performance) of a silver halide light-sensitive material.

The addition of the hydrazine compounds to a silver halide emulsion and a developing solution is disclosed in U.S. Pat. Nos. 3,730,727 (a developing solution in which ascorbic acid and hydrazine are combined), 3,227,552 (hydrazine is used as an auxiliary developing agent for obtaining a direct positive color image), 3,386,831 (β-mono-phenylhydrazide of aliphatic carboxylic acid is contained as a stabilizer for a silver halide light-sensitive material), and 2,419,975, and *The Theory of Photographic Process* written by Mees, the third edition (1966), p. 281.

Among them, in particular, it is disclosed in U.S. Pat. No. 2,419,975 that the addition of a hydrazine compound can provide a negative image with a high contrast.

It is described in the specification of the above patent that the addition of the hydrazine compound to a silver bromochloride emulsion and development in a developing solution of pH as high as 12.8 can provide a photographic characteristic with a very high contrast having gamma (γ) exceeding 10. However, a strongly alkaline developing solution is susceptible to air oxidation and is unstable. Accordingly, it is not durable in storage and use over a long time.

Methods have been attempted in which a silver halide light-sensitive material containing a hydrazine compound is developed in a developing solution of lower pH to form an image with a high contrast.

There are proposed in JP-A-1-179939 (the term "JP-A" as used herein means an unexamined published Japanese patent application) and 1-179940, processing methods in which a light-sensitive material containing a nucleus-forming development accelerator having an adsorbing group to silver halide emulsion grains and a nucleus-forming agent having an adsorbing group is developed in a developing solution of a pH 11 or lower. However, the compound having an adsorbing group has the defect that when it is added to a silver halide emulsion, the amount thereof exceeding certain limit deteriorates light sensitivity and inhibits a development or that it prevents the action of other more useful adsorptive additives. Accordingly, a sufficiently high contrast performance thereof can not be obtained since the use amount thereof is limited.

It is disclosed in JP-A-60-14030 that amines are added to a silver halide light-sensitive material increase in high contrast. However, in the case where development is carried out in a developing solution with a pH lower than 11.0, a sufficient high contrast can not be obtained.

It is disclosed in JP-A-56-106244 that an amino compound is added to a developing solution of a pH 10 to 12 to increase contrast. However, in the case where amines are added to the developing solution, there are the problems of odor of the solution, stain due to sticking thereof to the equipment used, and environmental pollution attributable to the waste solution. Those amines which are desired to be incorporated into a light-sensitive material and are actually added to provide sufficient performance have not yet been found.

There are disclosed in U.S. Pat. Nos. 4,998,604 and 4,994,365, hydrazine compounds having a recurring unit of ethylene oxide and hydrazine compounds having a pyridinium group. However, as is apparent from the examples, the high contrast is not sufficient and it is difficult to obtain high contrast and needed Dmax under practicable development processing conditions.

A nucleus-forming high contrast light-sensitive material in which a hydrazine derivative is used has a large fluctuation range of photographic performance according to changes in the pH of the developing solution. The pH value of the developing solution goes up due to air oxidation of the developing solution and the concentration thereof caused by the evaporation of water, and it is lowered due to the absorption of carbon dioxide in air, so that it is changed to a large extent. Accordingly, there is a need for a method to reduce the developing solution pH dependency of the photographic performance. Image quality which shows a sufficient high contrast and is good enough even with a processing by a developing solution having a pH of 11 or lower has not yet been obtained with conventional techniques.

SUMMARY OF THE INVENTION

Accordingly, the first object of the present invention is to provide a silver halide light-sensitive material having an improved photographic performance. The second object of the present invention is to provide a silver halide light-sensitive material which can provide a photographic performance of a very high negative contrast with a gamma value exceeding 10 by using a stable developing solution and which provides excellent image quality.

The first object of the present invention has been achieved by using a compound represented by the following Formula (I) or (II). The second object of the present invention has been achieved by a silver halide light-sensitive material comprising a support and having provided thereon at least one silver halide emulsion layer and containing a hydrazine derivative in the above emulsion layer and/or a layer adjacent thereto, wherein at least one compound represented by the following Formula (I) or (II) is contained in the above emulsion layer and/or a layer adjacent thereto:

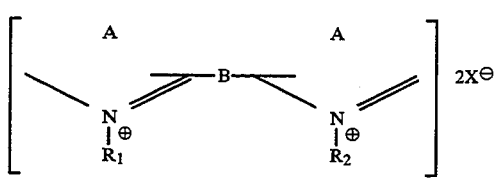

(I)

-continued (II)

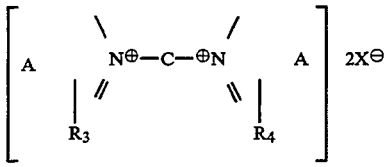

wherein A represents an organic group necessary for completing a hetero ring; B and C each represents a group constituted of one or more members selected from the group consisting of an alkylene group, an arylene group, an alkenylene group, $—SO_2—$, —SO—, —O—, —S—, and $—N(R_5)—$, where $R_5$ represents an alkyl group, an aryl group, or a hydrogen atom; $R_1$ and $R_2$ each represents an alkyl group; $R_3$ and $R_4$ each represents a substituent; and X represents an anion group, provided that X is not necessary when the compound is an inner salt.

BRIEF DESCRIPTION OF THE DRAWING

In FIGS. 1A–1E (1A) shows a transparent or translucent mounting base; (1B) shows a line original, in which a black part shows line; (1C) shows a transparent or translucent mounting base; (1D) shows a dot original and (1E) shows a contact light sensitive material, in which a hatched part shows photosensitive layer.

DETAILED DESCRIPTION OF THE INVENTION

Figure 1A:
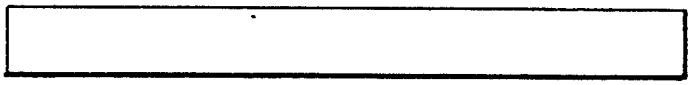
FIGS. 1A–1E show a chematical set up constitution for forming image on a contact light sensitive material on exposing to a light.
Figure 1B:
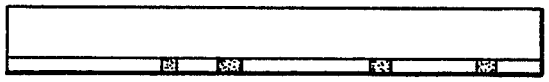
Figure 1C:
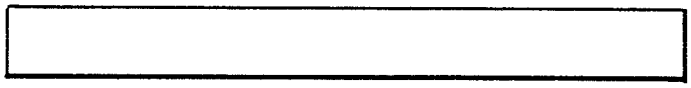
Figure 1D:
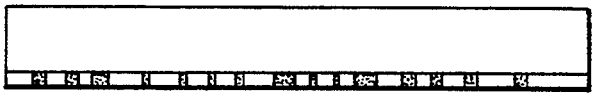
Figure 1E:
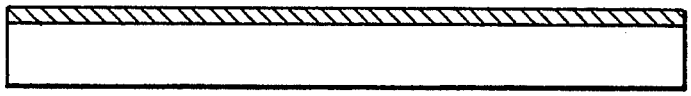

Formula (I) and Formula (II) are described in further detail.

In the formulas, A represents an organic group necessary for completing a hetero ring and may contain a carbon atom, a hydrogen atom, an oxygen atom, a nitrogen atom, or a sulfur atom. Further, a benzene ring may be condensed therewith. A 5- to 6-membered ring is the preferred example of the ring formed by A. A pyridine ring is the more preferred example thereof.

B and C each represents an alkylene group, an arylene group, an alkenylene group, $—SO_2—$, —SO—, —O—, —S—, or $—N(R_5)—$, or a group constituted by a plurality of these groups, where $R_5$ is an alkyl group, an aryl group, or a hydrogen atom. A group constituted by one or more members selected from the group consisting of an alkylene group, an arylene group, —O—, and —S— are the preferred examples of B and C.

$R_1$ and $R_2$ each represents an alkyl group having a carbon number of 1 to 20 and each may be the same or different. The alkyl group may be substituted with a substituent. These substituents include a halogen atom (for example, a chlorine atom and a bromine atom), a substituted or unsubstituted alkyl group (for example, methyl and hydroxyethyl), a substituted or unsubstituted aryl group (for example, phenyl, tolyl, and p-chlorophenyl), a substituted or unsubstituted acyl group for example, benzoyl, p-bromobenzoyl, and acetyl), a sulfo group, a carboxy group, a hydroxy group, an alkoxy group (for example, methoxy and ethoxy), an aryloxy group, an amide group, a sulfamoyl group, a carbamoyl group, a ureido group, an unsubstituted or alkyl-substituted amino group, a cyano group, a nitro group, an alkylthio group, and an arylthio group. $R_1$ and $R_2$ each represents an alkyl group having the carbon number of 1 to 10 as the preferred example thereof. There can be enumerated as examples of a preferred substituent, an aryl group, a sulfo group, a carboxy group, and a hydroxy group.

$R_3$ and $R_4$ each represents a substituent. The same substituents as those enumerated for $R_1$ and $R_2$ can be enumerated as examples of these substituents. As the preferred example, $R_3$ and $R_4$ each have a carbon number of 0 to 10. To be concrete, there can be enumerated an aryl-substituted alkyl group and a substituted or unsubstituted aryl group.

X represents an anion group, provided that X is not necessary in case of an inner salt. Examples of X include a chlorine ion, a bromine ion, an iodine ion, a nitric acid ion, a sulfuric acid ion, a p-toluenesulfonic acid ion, and oxalate.

The compounds of the present invention can readily be synthesized by generally known methods, and the following can be referred to, that is, *Quart. Rev.*, 16,163 (1962).

Specific compounds of Formula (I) and Formula (II) are shown below but the present invention will not be limited thereto.

(A-1)

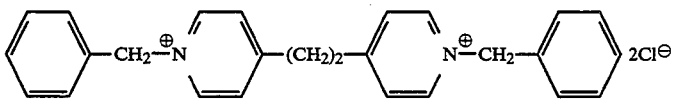

(A-2)

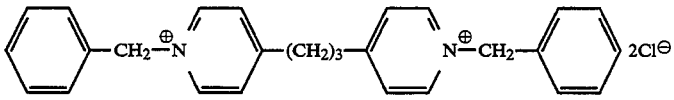

(A-3)

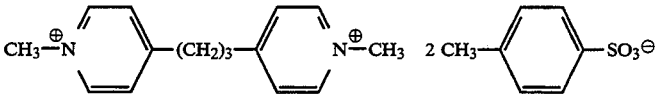

(A-4)

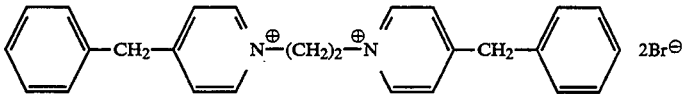

-continued (A-5)

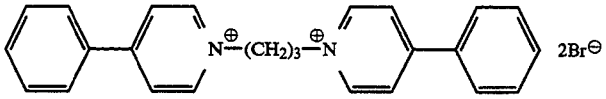

(A-6)

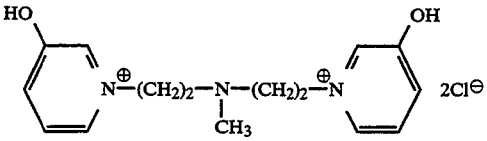

(A-7)

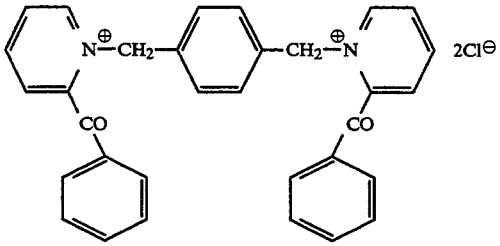

(A-8)

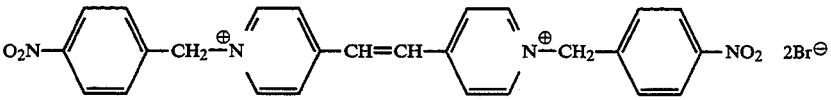

(A-9)

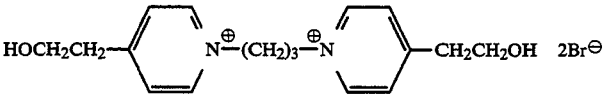

(A-10)

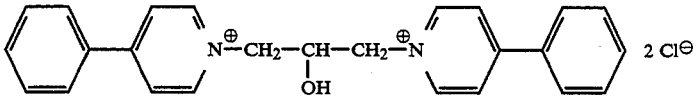

(A-11)

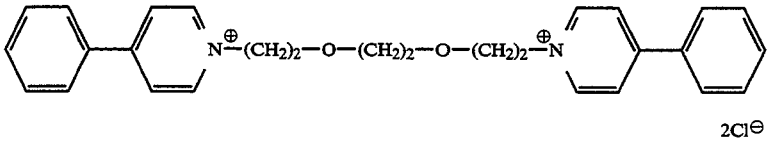

(A-12)

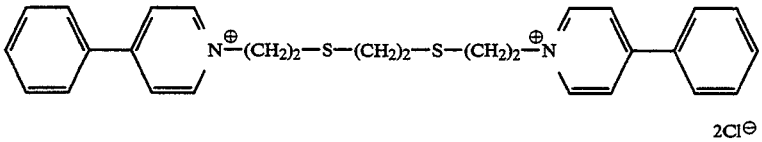

(A-13)

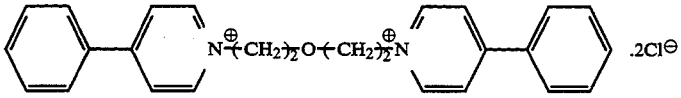

The compounds of Formula (I) and Formula (II) may be prepared in a conventional manner as disclosed herein below

SYNTHESIS EXAMPLE 1

Preparation of Compound (A-13)

34.1 g of 4-phenylpyridine, 14.3 g of bis(2-chloroethyl) ether and 80 ml of n-butanol were mixed and the mixture was stirred for 3 hours at 80° C. After completion of reaction, 160 ml of acetone was added and stirred under cooling with ice. A crystal precipitated was filtered off and dried to obtain 42.3 g of product having 108° to 112° C. m.p.

The product was confirmed by NMR spectrum, MS spectrum, IR spectrum and elemental analysis.

SYNTHESIS EXAMPLE 2

Preparation of Compound (A-1)

9.2 g of 1,2-bis(4-pyridyl)ethane, 14 g of benzylchloride and 40 ml of n-butanol were mixed and the mixture was stirred for 2 hours at 80° C. After completion of reaction, 80 ml of acetone was added and stirred under cooling with ice. A crystal precipitated was filtered off and dried to obtain 21.5 g of product having 122° C. m.p.

The product was confirmed by NMR spectrum, MS spectrum, IR spectrum and elemental analysis.

With respect to the addition amount of the compounds represented by Formula (I) and Formula (II), a suitable amount may be added and used according to the characteristics of a light-sensitive material, and it is not specifically limited. The preferred addition amount thereof is $1\times10^{-6}$ to $1\times10-3$ mol/m$^2$, more preferably $5\times10^{-6}$ to $5\times10^{-4}$ mol/m$^2$.

The compounds of the present invention represented by Formula (I) and Formula (II) can be used by dissolving them in a suitable water miscible organic solvent, for example, alcohols (methanol, ethanol, propanol, and fluorinated alcohol), ketones (acetone and methyl ethyl ketone), dimethylformamide, dimethylsulfoxide, and methyl cellosolve.

They can be dissolved with the aid of an oil such as dibutyl phthalate, tricresyl phosphate, glyceryl triacetate, and diethyl phthalate, and an auxiliary solvent such as ethyl acetate and cyclohexanone to mechanically prepare the emulsified dispersions thereof by a well known dispersing method. Alternatively, the powder of a compound according to Formula (I) or (II) can be dispersed in water by the method known as a solid matter dispersing method with a ball mill, a colloid mill or a supersonic wave.

The hydrazine derivative used in the present invention is explained. The hydrazine compound is not specifically limited and any compounds may be used according to necessity. The compound represented by the following Formula (III) can be enumerated as the preferred compound:

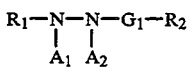

(III)

wherein $R_1$ represents an aliphatic group, an aromatic group, or a heterocyclic group and may or may not be substituted; $R_2$ represents a hydrogen atom, an alkyl group, an aryl group, an alkoxy group, an aryloxy group, an amino group, or a hydrazino group, and the groups other than the hydrogen atom may or may not be substituted; $G_1$ represents a carbonyl group, a sulfonyl group, a sulfoxy group, —P(O)($R_3$)— (where $R_3$ is selected from the same substituents as those defined for $R_2$), —C(O)C(O)—, a thiocarbonyl group, or an iminomethylene group; both $A_1$ and $A_2$ represent a hydrogen atom, or either of them represents a hydrogen atom and another represents a substituted or unsubstituted alkylsulfonyl group, a substituted or unsubstituted arylsulfonyl group, or a substituted or unsubstituted acyl group.

Formula (III) is explained in further detail.

In Formula (III), the aliphatic group represented by $R_1$ has preferably a carbon number of 1 to 30 and particularly is a linear, branched or cyclic alkyl group having a carbon number of 1 to 20. This alkyl group may have a substituent.

In Formula (III), the aromatic group represented by $R_1$ is a monocyclic or dicyclic aryl group or an unsaturated heterocyclic group, wherein the unsaturated heterocyclic group may be condensed with an aryl group.

Preferred as $R_1$ is an aryl group, particularly preferably an aryl group containing a benzene ring.

In the case where $R_1$ is an aliphatic group or aromatic group in Formula (III), there can be enumerated as typical substituents, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group, an aryloxycarbonyl group, an acyl group, a alkoxycarbonyl group, an acyloxy group, a carbonamide group, a sulfonamide group, a carboxyl group, a phosphoric amide group, a diacylamide group, an imide group, and $R_4$—NHC(O)—N($R_5$)C(O)— ($R_4$ and $R_5$ are selected from the same groups as those defined for $R_2$ and may be the same as or different from each other). The preferred substituents are an alkyl group (having preferably a carbon number of 1 to 20), an aralkyl group (having preferably a carbon number of 7 to 30), an alkoxy group (having preferably a carbon number of 1 to 20), a substituted amino group (preferably an amino group substituted with an alkyl group having a carbon number of 1 to 20), an acylamino group (having preferably a carbon number of 2 to 30), a sulfonamide group (having preferably a carbon number of 1 to 30), a ureido group (having preferably a carbon number of 1 to 30), and a phosphoric amide group (having preferably a carbon number of 1 to 30). These groups may further be substituted.

Further, it may contain the partial structure of —O—$(CH_2CH_2O)_n$—, —O—$[CH_2CH(CH_3)O)_n$—, or —O—$(CH_2CH(OH)CH_2O)_n$— (provided that n is an integer of 3 or more) as a part of the substituent, or may have a group containing a quaternary ammonium cation as a part of the substituent.

In Formula (III), the heterocyclic group represented by $R_1$ is a 3- to 10-membered saturated or unsaturated hereto ring containing at least one of an N, O and S atom. These rings may be a single ring or may further form a condensed ring with other aromatic or hetero rings. The hetero ring is preferably a 5- or 6-membered aromatic heterocyclic group. Preferred are those containing, for example, a pyridine group, an imidazolyl group, a quinolinyl group, a benzimidazolyl group, a pyrimidyl group, a pyrazolyl group, an isoquinolinyl group, a thiazoline group, and a benzothiazolyl group.

$R_1$ is preferably an aromatic group, a nitrogen-containing heterocyclic ring, or the group represented by the following Formula (b):

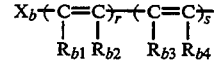

(b)

wherein $X_b$ represents an aromatic group or a nitrogen-containing heterocyclic group; $R_{b1}$ to $R_{b4}$ each represents a hydrogen atom, a halogen atom, or an alkyl group, and $X_b$ and $R_{b1}$ to $R_{b4}$ may have a substituent if possible; and r and s each represents 0 or 1.

$R_{b1}$ is preferably an aromatic group and an aryl group is particularly preferred.

$R_{b1}$ may be substituted with a substituent. There can be enumerated as examples of the substituents, an alkyl group, an aralkyl group, an alkenyl group, an alkynyl group, an alkoxy group, an aryl group, a substituted amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- or aryloxycarbonyl group, an acyl group, a alkoxycarbonyl group, an acyloxy group, a carbonamide group, a sulfonamide group, a nitro group, an alkylthio group, and an arylthio group. In addition thereto, the group represented by the following Formula (c) can be enumerated:

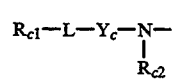

(c)

wherein $Y_c$ represents —CO—, —$SO_2$—, —P(O)($R_{c3}$)— (in which $R_{c3}$ represents an alkoxy group, such as methoxy, ethoxy, and hexanoxy or an aryloxy group, such as phenoxy, 4-chloro-phenoxy, 4-methyl-phenoxy, and 2-methyl-phenoxy), or —OP(O)($R_{c3}$)—; L represents a single bond, —O—, —S—, or $NR_{c4}$— (in which $R_{c4}$ represents a hydrogen atom, an alkyl group, or an aryl group); and $R_{c1}$ and $R_{c2}$ each represents a hydrogen atom, an aliphatic group, an aromatic group, or a heterocyclic group and may be the same or different, or may be combined with each other to form a ring.

Further, $R_1$ can contain one or more groups represented by Formula (c).

In Formula (c), the aliphatic group represented by $R_{c1}$ is a linear, branched or cyclic alkyl group, an alkenyl group, or an alkynyl group having 1 to 30 carbon atoms.

The aromatic group represented by $R_{c1}$ is a monocyclic or dicyclic aryl group and there can be enumerated, for example, a phenyl group and a naphthyl group.

The hetero ring represented by $R_{c1}$ is a 3- to 10-membered saturated or unsaturated hetero ring containing at least one of an N, O or S atom. These may be a single ring or may further form a condensed ring with the other aromatic or hetero rings. The hetero ring is preferably a 5- or 6-membered aromatic heterocyclic group. Preferred are those containing, for example, a pyridine group, an imidazolyl group, a quinolinyl group, a benzimidazolyl group, a pyrimidyl group, a pyrazolyl group, an isoquinolinyl group, a thiazolyl group, and a benzothiazolyl group.

$R_{c1}$ may be substituted with a substituent. For example, the following can be enumerated as the substituents. These groups may further be substituted.

They are, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- and arytoxycarbonyl group, an acyl group, an alkoxycarbonyl group, an acyloxy group, a carbonamide group, a sulfonamide group, a nitro group, an alkylthio group, and an arylthio group.

These groups may be combined with each other to form a ring if possible.

The aliphatic group represented by $R_{c2}$ in Formula (c) is a linear, branched or cyclic alkyl group, an alkenyl group, or an alkynyl group having 1 to 30 carbon atoms.

The aromatic group represented by $R_{c2}$ is a monocyclic or dicyclic aryl group, and for example a phenyl group.

$R_{c2}$ may be substituted with a substituent. There can be enumerated as the substituents, for example, those enumerated as the substituents for $R_{c1}$.

Further, $R_{c1}$ and $R_{c2}$ may be combined with each other to form a ring if possible.

A hydrogen atom is more preferred as $R_{c2}$.

Particularly preferred as $Y_c$ in Formula (c) are —CO— and —$SO_2$—, and L is preferably a single bond or —$NR_{c4}$—.

The aliphatic group represented by $R_{c4}$ in Formula (c) is a linear, branched or cyclic alkyl group, an alkenyl group, or an alkynyl group having 1 to 30 carbon atoms.

The aromatic group represented by $R_{c4}$ is a monocyclic or dicyclic aryl group, for example a phenyl group.

$R_{c4}$ may be substituted with a substituent. There can be enumerated as the substituent, for example, those enumerated as substituents for $R_{c1}$.

A hydrogen atom is more preferred as $R_{c4}$.

In the case where $G_1$ is a —C(O)— group, the preferred group represented by $R_2$ is a hydrogen atom, an alkyl group having 1 to 30 carbon atoms (for example, methyl, trifluoromethyl, 3-hydroxypropyl, 3-methanesulfonamidepropyl, n-propyl, methoxyethyl, methoxymethyl, phenoxymethyl, and phenylsulfonylmethyl), an aralkyl group having 1 to 30 carbon atoms (for example, o-hydroxybenzyl), and an aryl group (for example, phenyl, 3,5-dichlorophenyl, o-methanesulfonamidephenyl, 4-methanesulfonylphenyl, 4-cyanophenyl, 4-bromophenyl, 2,5-dichlorophenyl, and 2-hydoxymethylphenyl).

Further, $R_2$ may permit a portion of $G_1$–$R_2$ to split off from the remainder of the compound of Formula (III) and may cause a cyclization reaction in which a cyclic structure containing the atoms in the portion of —$G_1$–$R_2$ is formed. There can be enumerated as examples thereof, the compounds described in JP-A-63-29751.

A hydrogen atom is the most preferable as $A_1$ and $A_2$.

$R_1$ or $R_2$ in Formula (III) may have a ballast group or a polymer incorporated thereinto, which is conventionally used for an immobile photographic additive such as a coupler. The ballast group is a group which has 8 or more carbon atoms and is comparatively inactive on photographic characteristics, and can be selected from, for example, an alkyl group, an alkoxy group, a phenyl group, an alkylphenyl group, a phenoxy group, and an alkylphenoxy group. Also, the compounds described in JP-A-1-100530 can be enumerated as the polymer.

A group promoting adsorption to the surface of a silver halide grain may be incorporated into $R_1$ or $R_2$ in Formula (III). There can be enumerated as such adsorbing groups, the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246, such as a thiourea group, a heterocyclic thioamide group, a mercapto heterocyclic group, and a triazole group.

Examples of the compounds represented by Formula (III) are shown below but the present invention is not limited to the following compounds.

(N-1)
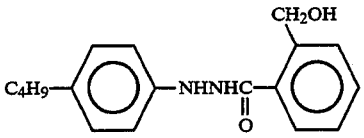
(N-2)
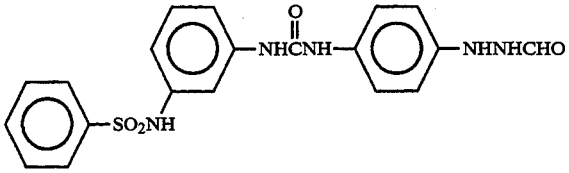
(N-3)
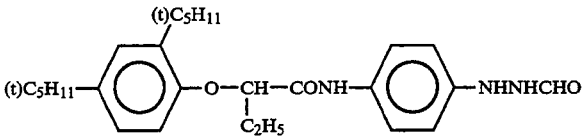
(N-4)
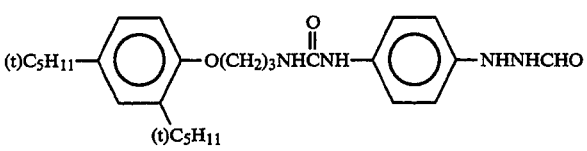
(N-5)
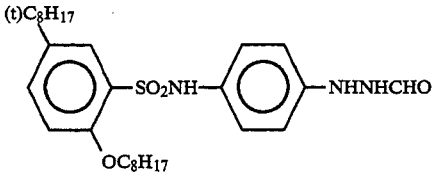
(N-6)
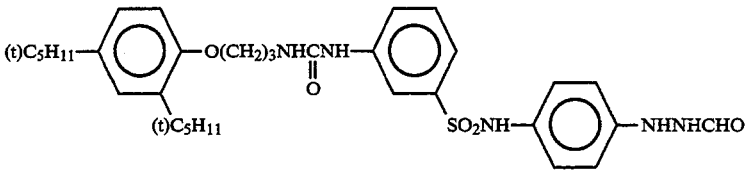
(N-7)
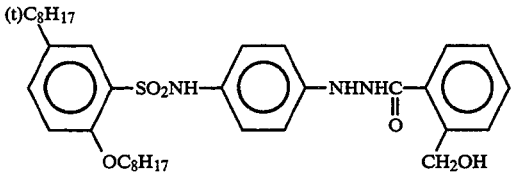
(N-8)
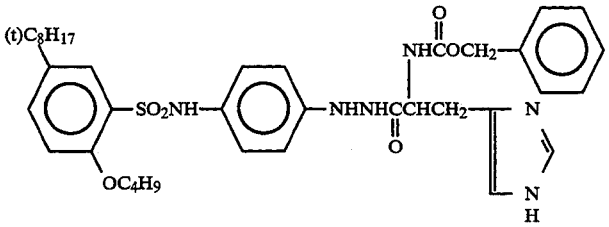
(N-9)
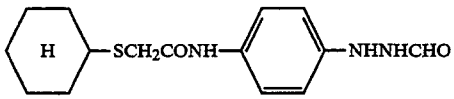

-continued
(N-10)
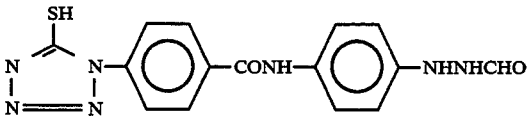
(N-11)
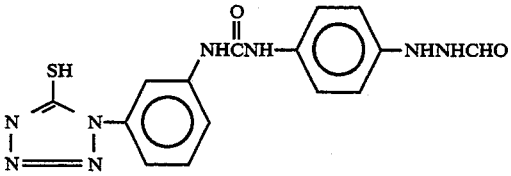
(N-12)
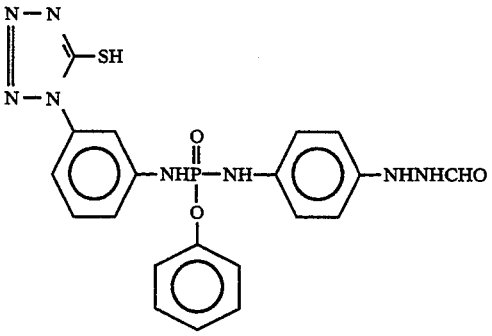
(N-13)
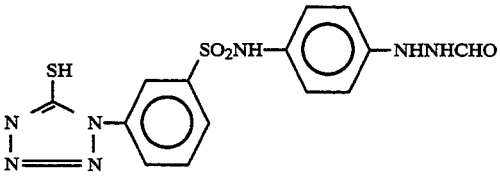
(N-14)
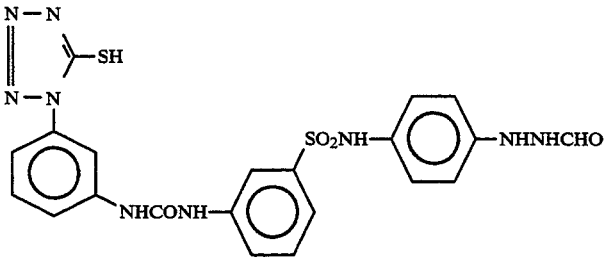
(N-15)
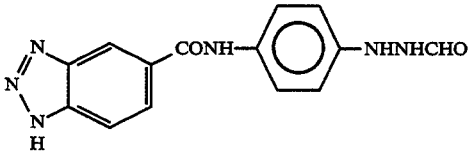
(N-16)
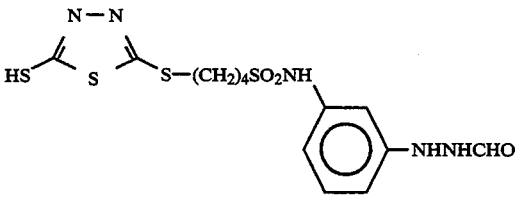

-continued
(N-17)
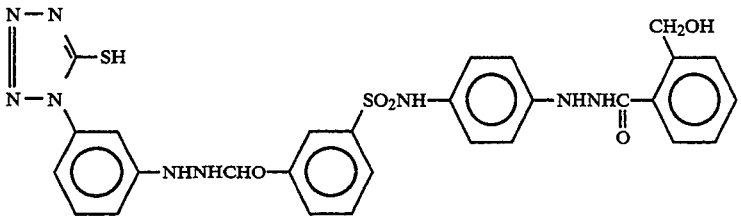
(N-18)
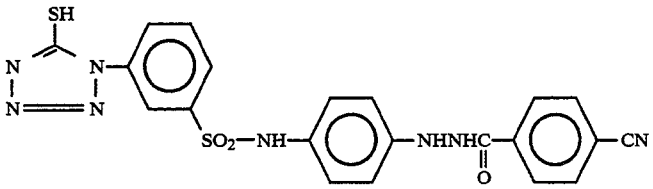
(N-19)
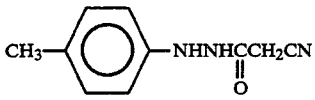
(N-20)
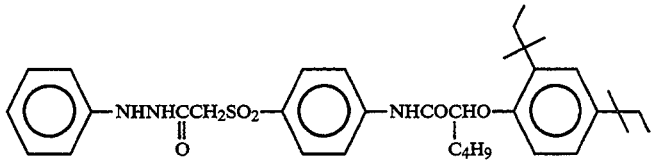
(N-21)
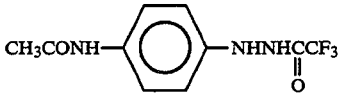
(N-22)
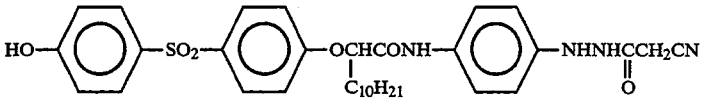
(N-23)
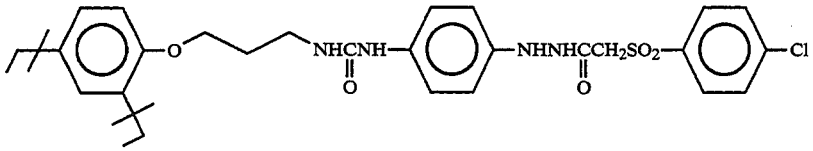
(N-24)
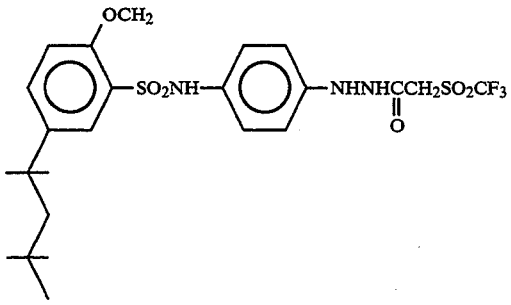
(N-25)
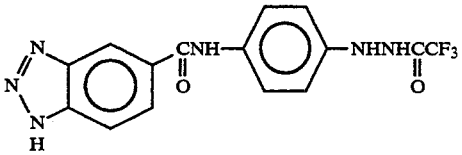

-continued
(N-26)
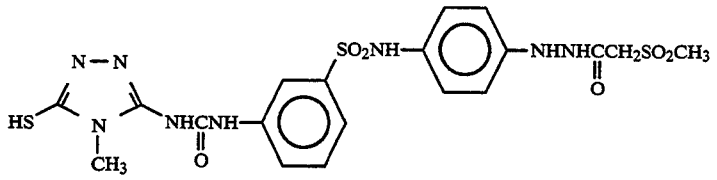
(N-27)
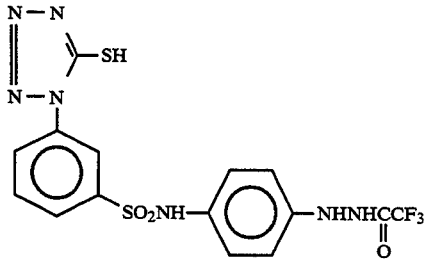
(N-28)
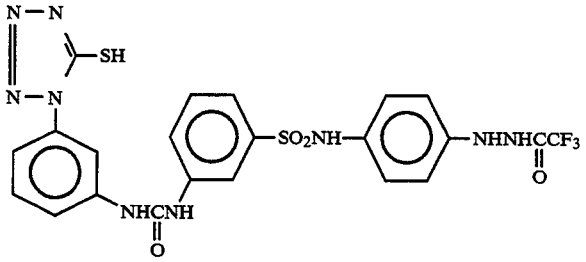
(N-29)
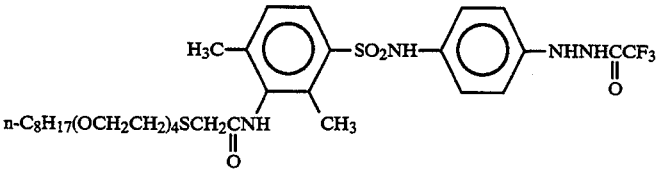
(N-30)
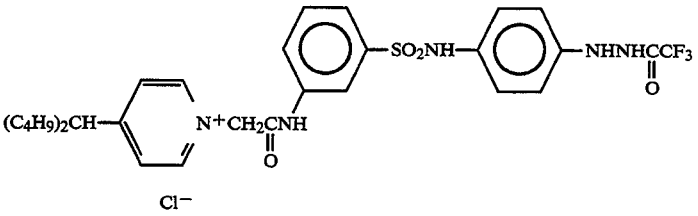
(N-31)
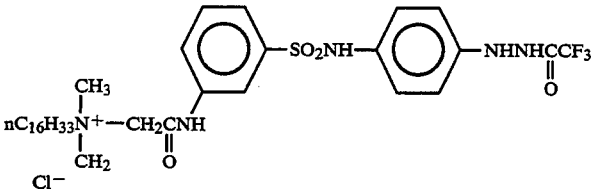
(N-32)
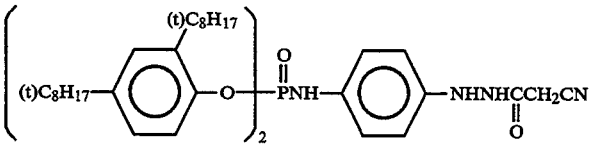

-continued
(N-33)
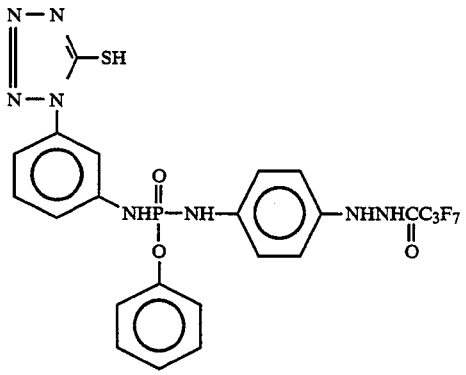
(N-34)
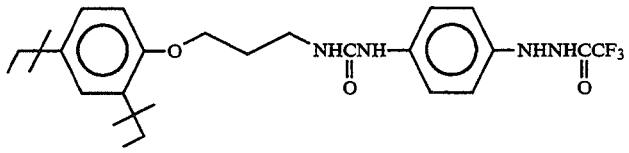
(N-35)
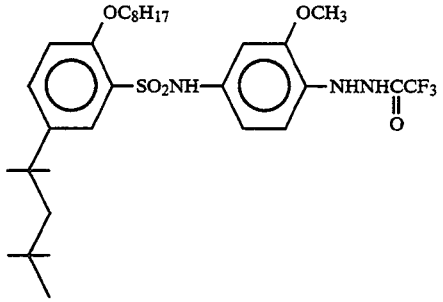
(N-36)
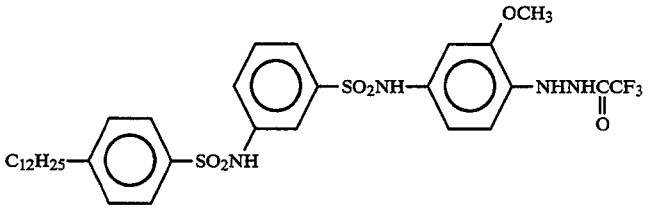
(N-37)
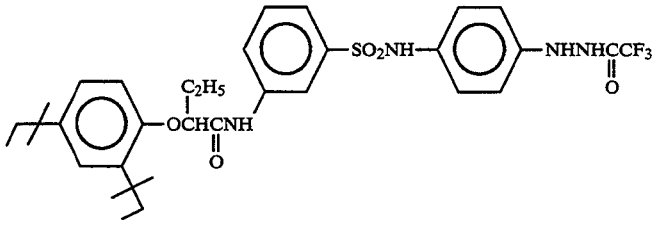
(N-38)
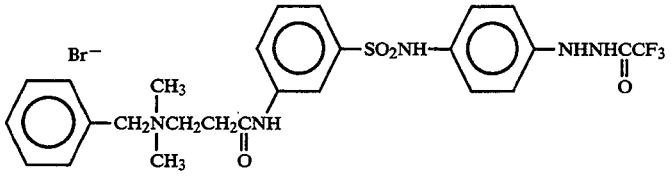

-continued
(N-39)
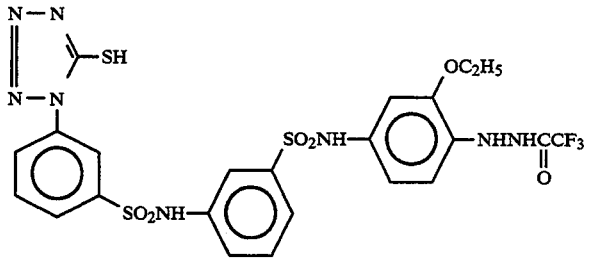
(N-40)
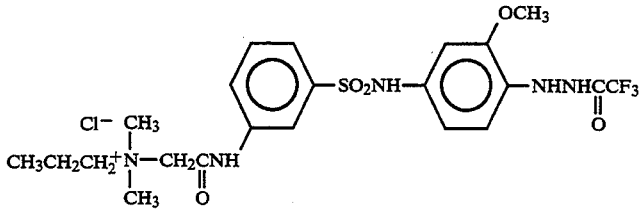
(N-41)
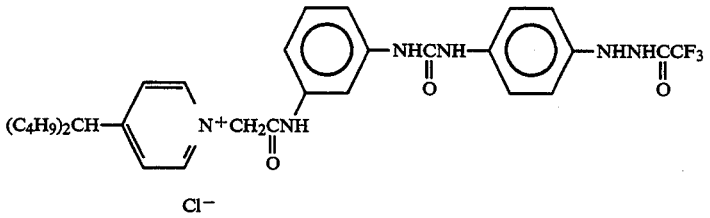
(N-42)
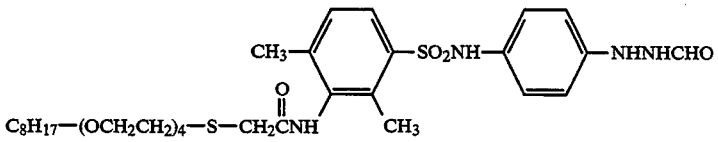
(N-43)
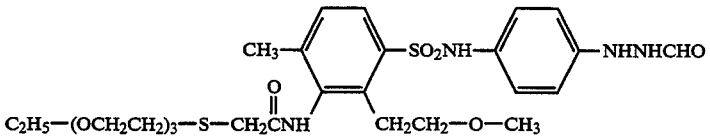
(N-44)
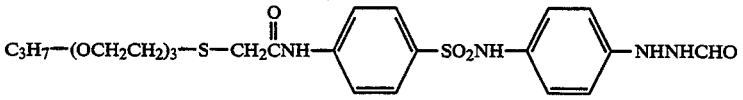
(N-45)
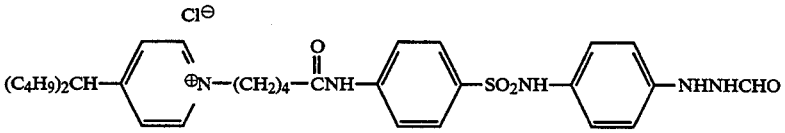
(N-46)
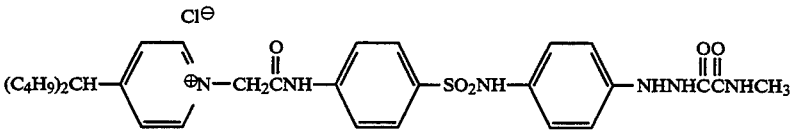
(N-47)
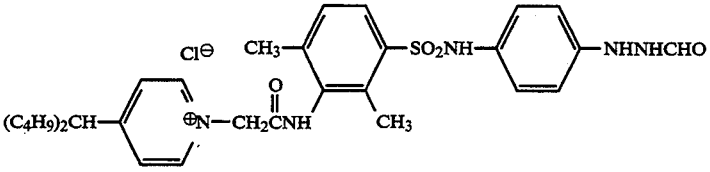

-continued
(N-48)
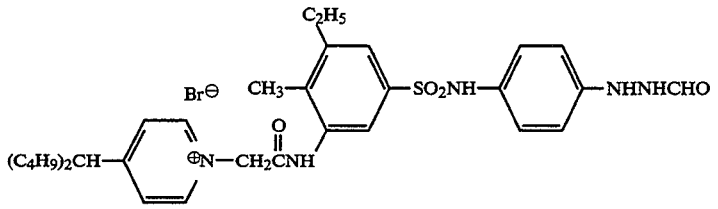
(N-49)
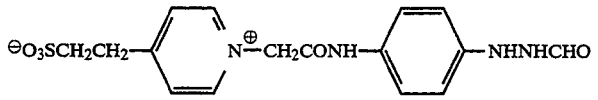
(N-50)
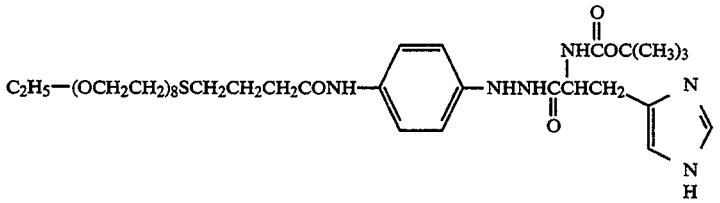
(N-51)
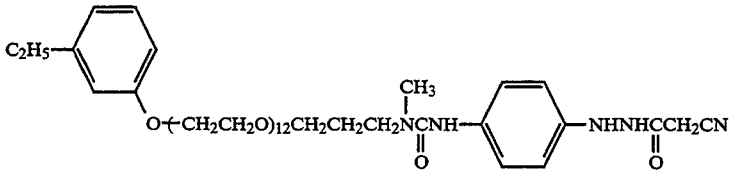
(N-52)
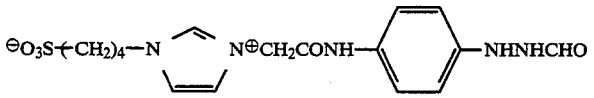
(N-53)
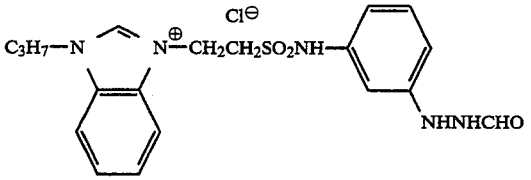
(N-54)
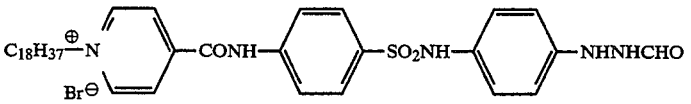
(N-55)
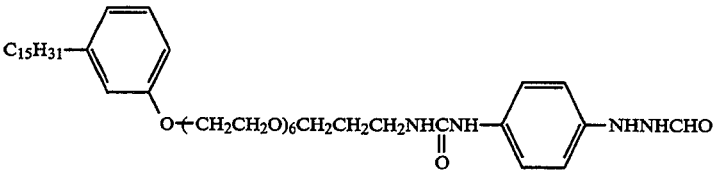
(N-56)
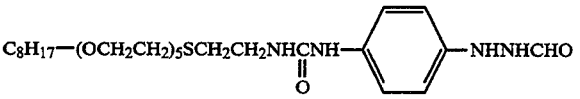

-continued (N-57)

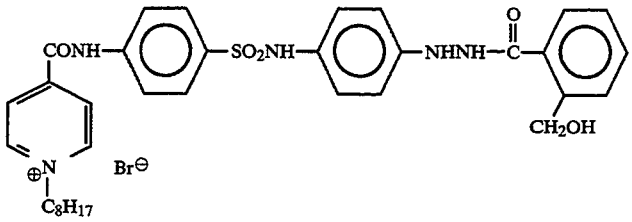

(N-58)

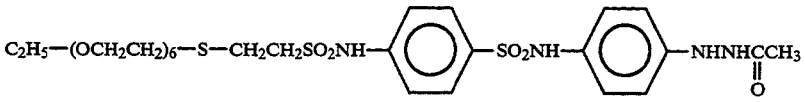

(N-59)

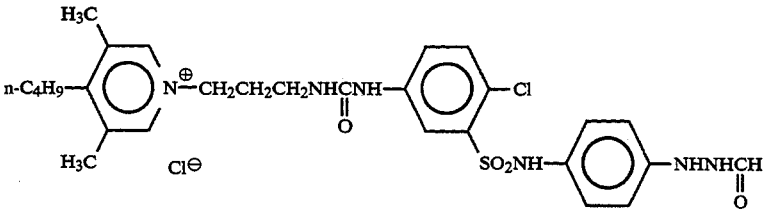

(N-60)

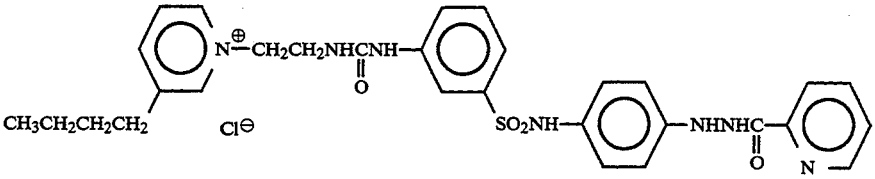

(N-61)

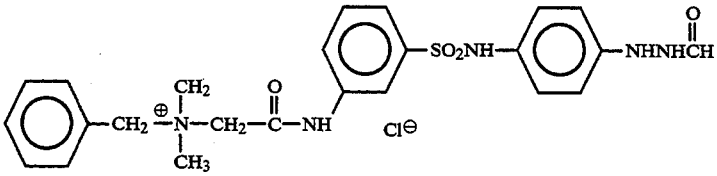

(N-62)

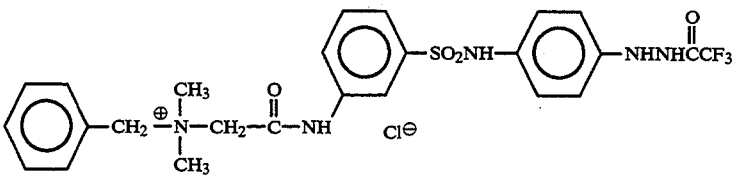

In addition to the above compounds, there can be used as the hydrazine derivative in the present invention, the compounds described in *Research Disclosure* item 23516 (November 1983, p. 346) and the publications cited therein, and in addition, U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, and JP-A-62-270,948, EP 217,310, EP 356,898, U.S. Pat. No. 4,686,167, and JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100,530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-63-147339, JP-A-63-179760, JP-A-63-229163, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750, and JP-A-2-304550.

In the present invention, the addition amount of the hydrazine derivative is preferably $1\times10^{-6}$ to $5\times10^{-2}$ mole per mole of silver halide, and in particular, the preferred addition amount falls within the range of $1\times10^{-5}$ to $2\times10^{-2}$ mole per mole of silver halide.

The hydrazine derivatives used in the present invention can be dissolved in a suitable water miscible organic solvent, for example, alcohols (methanol, ethanol, propanol, and fluorinated alcohol), ketones (acetone and methyl ethyl ketone), dimethylformamide, dimethylsulfoxide, and methyl cellosolve to use them.

Further, the hydrazine derivatives can be dissolved with the aid of an oil such as dibutyl phthalate, tricresyl phosphate, glyceryl triacetate, and diethyl phthalate, and an auxiliary solvent such as ethyl acetate and cyclohexanone to mechanically prepare the emulsified dispersions thereof by a well known dispersing method. Alternatively, the powder of the hydrazine derivative can be dispersed in water by the method known as a solid matter dispersing method with a ball mill, a colloid mill or a supersonic wave.

The halogen composition of the silver halide emulsion used in the present invention has a silver chloride content of 60 mole % or more and consists of any of silver chloride, silver bromochloride, silver chloroiodide, and silver bromochloroiodide. The silver iodide content thereof is 3 mole % or less, more preferably 0.5 mole % or less.

Various methods known in the field of silver halide photographic light-sensitive materials can be used to prepare the silver halide emulsion used in the present invention. It can be prepared by the methods described in, for example, *Chimie et Physique Photographique* written by P. Glafkides (published by Paul Montel Co., 1967), *Photographic Emulsion Chemistry* written by G. F. Duffinu (published by Focal Press Co., 1966), and *Making and Coating Photographic Emulsion* written by V. L. Zelikman et al (published by Focal Press Co., 1964).

The emulsion used in the present invention is preferably a monodispersed emulsion and has a fluctuation coefficient of 20% or less, particularly preferably 15% or less.

The grains contained in the monodispersed silver halide emulsion have an average grain size of 0.5 μm or less, particularly preferably 0.1 to 0.4 μm.

Any of a single jet method, a double jet method and a combination thereof may be used as the method for reacting a water soluble silver salt (a silver nitrate aqueous solution) with a water soluble halide. There can be used as one form of the double jet method, the method in which pAg of the solution in which the sliver halide grains are formed is maintained constant, that is, a controlled double jet method. A so-called silver halide solvent such as ammonia, thioether, and tetra-substituted thiourea is preferably used to form the grains.

It is more preferably a tetra-substituted thiourea compound and is described in JP-A-53-82408 and JP-A-55-77737. The preferred thiourea compounds include tetramethyl thiourea and 1,3-dimethyl-2-imidazolidinethione.

The silver halide emulsion having a regular crystal form and a narrow grain size distribution can readily be prepared with the controlled double jet method and the grain forming method in which the silver halide solvent is used.

The monodispersed emulsion preferably has a regular crystal form such as cube, octahedron and tetradecahedron. In particular, cube is preferred.

The silver halide grains may consist of either a phase in which the inside and surface thereof are uniform or a phase in which they are different.

A cadmium salt, a sulfite salt, a lead salt, a thallium salt, a rhodium salt or a complex salt thereof, an iridium salt or a complex salt thereof may be allowed to coexist with the silver halide emulsion used in the present invention during the process of formation of the silver halide grains and during physical ripening.

In the present invention, the silver halide emulsion particularly suitable as the light-sensitive materials for photographing a line drawing and preparing a halftone dot is the emulsion prepared in the presence of the iridium salt or complex salt thereof of $10^{-8}$ to $10^{-5}$ mole per mole of silver.

In this case, the above amount of the iridium salt is preferably added before the completion of physical ripening in the manufacturing process of a silver halide emulsion, particularly in the formation of the grains.

The iridium salt used herein is a water soluble iridium salt or an iridium complex salt and includes, for example, iridium trichloride, iridium tetrachloride, potassium hexachloroiridate (III), potassium hexachloroiridate (IV), and ammonium hexachloroiridate (III).

The known methods such as sulfur sensitization, reduction sensitization, and gold sensitization can be used for chemical sensitization of the monodispersed emulsion used in the present invention. They can be used singly or in combination thereof. The preferred chemical sensitizing method is sulfur sensitization.

There can be used as the sulfur sensitizer, various sulfur compounds, for example, thiosulfates, thioureas, thiazoles, and rhodanines, as well as the sulfur compounds contained in gelatin. Examples thereof include those described in U.S. Pat. Nos. 1,574,944, 2,278,947, 2,410,689, 2,728,668, 3,501,313, and 3,656,955. The preferred sulfur compounds are thiosulfate and a thiourea compound. The pAg in the chemical sensitization falls preferably within the range of 8.3 or less, more preferably 7.3 to 8.0. Further, as reported by Moisar, *Klein Gelatine. Proc. Syme.* 2nd, 301 to 309 (1976), the method in which polyvinyl pyrrolidone and thiosulfate are used in combination gives a good result as well.

Among the noble metal sensitizing methods, the gold sensitizing process is a typical one and a gold compound, mainly a gold complex salt is used. There may be contained as well the noble metals other than gold, for example, the complex salts of platinum, palladium, and iridium. Concrete examples thereof are described in U.S. Pat. No. 2,448,060 and British Patent 618,061.

In the present invention, the silver halide emulsion particularly suitable for the light-sensitive material for dot to dot work comprises silver chloride of 90 mole % or more, more preferably 95 mole % or more and silver bromide or silver bromochloride containing 0 to 10 mole % of silver bromide. The increase in the proportion of silver bromide or silver iodide is not preferred since a safe-light safety in a daylight is deteriorated or $\gamma$ is lowered.

The silver halide emulsion of the present invention contains preferably a transition metal complex. The transition metals include Rh, Ru, Re, Os, Ir, and Cr.

There can be enumerated as a ligand, the nitrosyl and thionitrosyl ligands, a halide ligand (fluoride, chloride, bromide and iodide), a cyanide ligand, a cyanate ligand, a thiocyanate ligand, a selenocyanate ligand, tellurocyanate ligand, an acid ligand, and an aquo ligand. In the case where the aquo ligand is present, it occupies preferably one or two of the ligands.

To be concrete, a rhodium atom can be converted to an arbitrary form of a metal salt such as a single salt and a complex salt to add it in the preparation of the grains.

There can be enumerated as the rhodium salt, rhodium monochloride, rhodium dichloride, rhodium trichloride, and ammonium hexachlororhodate. Preferred is a water soluble trivalent rhodium halogen complex compound, for example, hydrogen hexachlororhodate (III) or the salt thereof (an ammonium salt, a sodium salt and a potassium salt).

These rhodium salts are used in an addition amount falling within the range of $1.0\times10^{-6}$ to $1.0\times10^{-3}$ mole, preferably $1.0\times10^{-5}$ to $1.0\times10^{-3}$ mole, particularly preferably $5.0\times10^{-5}$ to $5.0\times10^{-4}$ mole, per mole of silver halide.

Further, the following transition metal complexes are preferred as well:

1. $[Ru(NO)Cl_5]^{-2}$
2. $[Ru(NO)_2Cl_4]^{-1}$
3. $[Ru(NO)(H_2O)Cl_4]^{-1}$
4. $[Ru(NO)Cl_5]^{-2}$
5. $[Rh(NO)Cl_5]^{-2}$
6. $[Re(NO)Cl_5]^{-2}$
7. $[Re(NO)ClCN_4]^{-2}$
8. $[Rh(NO)_2Cl_4]^{-1}$
9. $[Rh(NO)(H_2O)Cl_4]^{-1}$
10. $[Ru(NO)CN_5]^{-2}$
11. $[Ru(NO)Br_5]^{-2}$
12. $[Rh(NS)Cl_5]^{-2}$
13. $[Os(NO)Cl_5]^{-2}$
14. $[Cr(NO)Cl_5]^{-3}$
15. $[Re(NO)Cl_5]^{-1}$
16. $[Os(NS)Cl_4(TeCN)]^{-2}$
17. $[Ru(NS)I_5]^{-2}$
18. $[Re(NS)Cl_4(SeCN)]^{-2}$
19. $[Os(NS)Cl(SCN)_4]^{-2}$
20. $[Ir(NO)Cl_5]^{-2}$

According to the present invention, 1 to 3 hydrophilic colloid layers may be provided between the support and emulsion layer, over the surface of the emulsion layer, or between two emulsion layers.

Obtaining a highly sensitive photographic performance with a supersonic wave in the silver halide light-sensitive material of the present invention does not necessitate the use of a conventional infectious developing solution or a highly alkaline developing solution having a pH close to 13, described in U.S. Pat. No. 2,419,975. Accordingly, a stable developing solution can be used.

That is, using the silver halide light-sensitive material of the present invention, a negative image with a sufficiently high contrast can be obtained with a developing solution containing the sulfite ion of 0.15 mole/liter or more as a preservative and having pH of 9.6 to 11.0.

The developing agent applied to the developing solution used in the present invention is not specifically limited. Dihydroxybenzenes are preferably contained therein for easily obtaining a good halftone dot quality. There are used in some cases, combinations of dihydroxybenzenes and 1-phenyl-3-pyrazolidones, or combinations of dihydroxybenzenes and p-aminophenols.

The dihydroxybenzene developing agent used in the invention includes hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Of them, hydroquinone is particularly preferred.

The developing agent 1-phenyl-3-pyrazolidone or the derivatives thereof used in the present invention includes 1-phenyl-3-pyrazolidone, 1-phenyl-4,4-dimethyl-4-pyrazolidone, 1-phenyl-4-methyl-4-hydroxymethyl-3pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

The p-aminophenol series developing agent used in the present invention includes N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Among them, N-methyl-p-aminophenol is preferred.

Usually, the developing agent is used preferably in an amount of 0.05 to 0.8 mol/liter. In the case where the combination of dihydroxybenzenes and 1-phenyl-3-pyrazolidones or p-aminophenols is used, the former is used preferably in an amount of 0.05 to 0.5 mol/liter and the latter in an amount of 0.06 mol/liter or less.

The sulfite preservatives used in the present invention include sodium sulfite, potassium sulfite, lithium sulfite, ammonium sulfite, sodium bisulfite, potassium metabisulfite, and sodium formaldehyde bisulfite. Sulfites are added preferably in an amount of 0.15 mole/liter or more, particularly preferably 0.3 mole/liter or more. The upper limit thereof is preferably up to 2.5 mole/liter.

An alkali agent used for setting pH includes a pH controlling agent and a buffer agent such as sodium hydroxide, potassium hydroxide, sodium carbonate, potassium carbonate, sodium tertiary phosphate, and potassium tertiary phosphate. The pH value of a developing solution is set in the range of 9.6 to 11.0.

There may be contained as the additives other than the components mentioned above, a development inhibitor such as a compound including boric acid and borax, sodium bromide, potassium bromide, and potassium iodide; an organic solvent such as ethylene glycol, diethylene glycol, triethylene glycol, dimethylformamide, methyl cellosolve, hexylene glycol, methanol, and ethanol; an anti-fogging agent or an anti-black pepper agent such as 1-phenyl-5-mercaptotetrazole, an indazole series compound including 5-nitroindazole, and a benzotriazole series compound including 5-methylbenzotriazole. Further, there may be contained according to necessity, a color toning agent, a surface active agent, a defoaming agent, a water softening agent, a hardener, and the amino compounds described in JP-A-56-106244.

The compounds described in JP-A-56-24347 can be used as an anti-silver stain agent for the developing solution in the present invention. The compounds described in JP-A-60-109743 can be used as a dissolution aid added to the developing solution. Further, the compounds described in JP-A-60-93433 or the compounds described in JP-A-61-28708 can be used as a pH buffer agent used for the developing solution.

Those compositions generally used can be used as a fixing agent. There can be used as the fixing agent, the organic sulfur compounds having the effect known as a fixing agent in addition to thiosulfate and thiocyanate. A water soluble aluminum salt (for example, aluminum sulfate and alum) may be contained in the fixing solution as a hardener, wherein the amount of the water soluble aluminum salt is usually 0.4 to 2.0 g-Al/liter. Further, a trivalent ferric compound can be used as an oxidizing agent in the form of the complex with ethylenediaminetetraacetic acid.

A development processing temperature can be selected between 18° to 50° C., more preferably 25° to 43° C.

The various additives used for the light-sensitive material of the present invention are not specifically limited, and those described in the following corresponding portions can be preferably applied.

| Subject | Corresponding portion |
|---|---|
| 1) Nucleus forming accelerator | Formula (II-m) or (II-p) and the compound example II-1 or II-22 at p. 9, right upper column, line 13 to p. 16, left upper column, line 10 of JP-A-2-103536; and the compounds described in JP-A-1-179939. |
| 2) Spectral sensitizing dye which may | p. 8, left lower column, line 13 to right lower column, line |

-continued

| Subject | Corresponding portion |
|---|---|
| be used in combination | 4 of JP-A-2-12236; p. 16, right lower column, line 3 to p. 17, left lower column, line 20 of JP-A-2-103536; and further the spectral sensitizing dyes described in JP-A-1-112235, JP-A-2-124560, JP-A-3-7928, JP-A-5-11389, and Japanese patent application 3-411064. |
| 3) Surface active agent | p. 9, right upper column, line 7 to right lower column, line 7 of JP-A-2-12236; and p. 2, left lower column, line 13 to p. 4, right lower column, line 18 of JP-A-2-18542. |
| 4) Anti-fogging agent | p. 17, right lower column, line 19 to p. 18, right upper column, line 4 and right lower column, lines 1 to 5 of JP-A-2-103526; and further the thiosulfinic acid compounds described in JP-A-1-237538. |
| 5) Polymer latex | p. 18, left lower column, lines 12 to 20 of JP-A-2-I03536. |
| 6) Compound having an acid group | p. 18, right lower column, line 6 to p. 19, left upper column, line 1 of JP-A-2-103536. |
| 7) Matting agent, sliding agent and plasticizer | p. 19, left upper column, line 15 to right upper column, line 15 of JP-A-2-103536. |
| 8) Hardener | p. 18, right upper column, lines 5 to 17 of JP-A-2-103536. |
| 9) Dye | dyes described at p. 17, right lower column, lines 1 to 18 of JP-A-2-103536; and solid dyes described in JP-A-2-294638 and Japanese patent application 3-185773. |
| 10) Binder | p. 3, right lower column, lines 1 to 20 of JP-A-2-18542. |
| 11) Anti-black pepper agent | the compounds described in U.S. Pat. 4,956,257, and JP-A-1-118832. |
| 12) Monomethine compound | the compounds of Formula (II) (particularly the compound example II-1 or II-26) described in JP-A-2-287532. |
| 13) Dihydroxybenzenes | p. 11, left upper column to p. 12 left lower column of JP-A-3-39948; and the compounds described in EP 452772A. |

The present invention will be concretely explained below with reference to the examples but the present invention will not be limited thereto.

First, the preparation of the silver halide emulsions used in the following examples will be explained.

Emulsion A:

A silver nitrate aqueous solution of 0.37 mole and a halide aqueous solution containing $(NH_4)_3RhCl_6$ corresponding to $1.0\times10^{-7}$ mole and $K_2IrCl_6$ of $2\times10^{-7}$ mole each per mole of silver contained in a finished emulsion, potassium bromide of 0.11 mole, and sodium chloride of 0.27 mole were added to a gelatin aqueous solution containing sodium chloride and 1,3-dimethyl-2-imidazolidinethione by a double jet method at 45° C. for 12 minutes while stirring. Silver bromochloride grains having an average grain size of 0.20 μm and a silver chloride content of 70 mole % were obtained to thereby form nuclei. Subsequently, a silver nitrate aqueous solution of 0.63 mole and a halide aqueous solution containing potassium bromide of 0.19 mole and sodium chloride of 0.47 mole were similarly added by a double jet method over a period of 20 minutes. Then, a KI solution of $1\times10^{-3}$ mole per mole of silver was added to carry out a conversion and washing was carried out by a flocculation method according to a conventional method, followed by adding gelatin 40 g and adjusting pH and pAg to 6.5 and 7.5, respectively. Further, there were added sodium benzenethiosulfate (7 mg), sodium thiosulfate (5 mg), and chlorauric acid (8 mg) each per mole of silver. Heating was applied at 60° C. for 45 minutes to provide a chemical sensitization processing, followed by adding 4-hydroxy-6-methyl-1,3,3a,7-tetrazaindene (150 mg) as a stabilizer and Proxel as a preservative. The grains thus obtained were silver bromochloride cubic grains having an average grain size of 0.28 μm and a silver chloride content of 70 mole % (coefficient of variation: 9%).

Emulsion B:

A silver nitrate aqueous solution and an aqueous solution of potassium iodide and potassium bromide were simultaneously added to a gelatin aqueous solution maintained at 50° C. in the presence of potassium hexachloroiridate (III) of $4\times10^{-7}$ mole per mole of silver and ammonia for 60 minutes, and pAg was maintained at 7.8 during that time. A cubic monodispersed emulsion having an average grain size of 0.28 μm and an average silver iodide content of 0.1 mole % resulted. This emulsion was desalted by a flocculation method and then, inactive gelatin of 40 g per mole of silver was added. Subsequently, there were added 5,5'-dichloro-9-ethyl-3,3'-bis-(3-sulfopropyl)-oxacarbocyanine, Dyes (S-2) and (S-3) each of $1.1\times10^{-4}$ mole per mole of silver, and a KI aqueous solution of $10^{-3}$ mole per mole of silver while maintaining the temperature at 50° C. The emulsion was left to stand for 15 minutes and then cooled down.

Sensitizing Dyes used in the Examples:

(S-1)

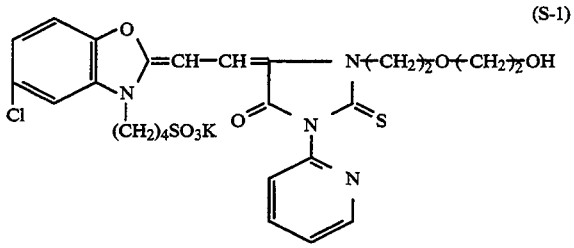

(S-2)

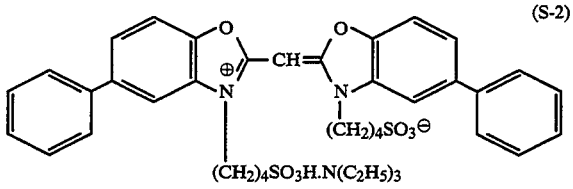

(S-3)

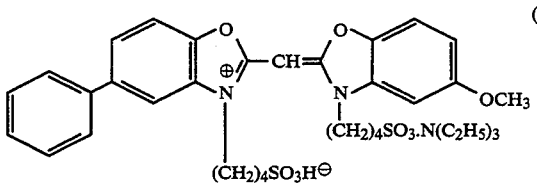

-continued

Sensitizing Dyes used in the Examples:

(S-4)

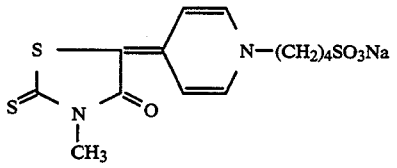

(S-5)

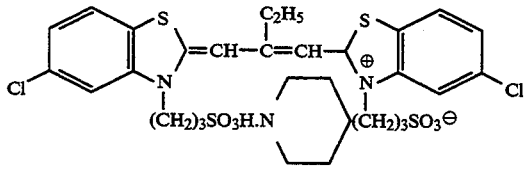

(S-6)

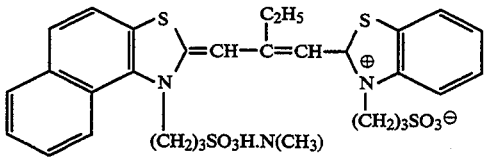

Emulsion C:

A silver nitrate aqueous solution and a sodium chloride aqueous solution were simultaneously added to a gelatin aqueous solution maintained at 40° C. in the presence of $(NH_4)_3RhCl_6$ of $5.0\times10^{-6}$ mole per mole of silver. Soluble salts were removed by a method known in the art, and then gelatin was added, followed by adding 2-methyl-4-hydroxy-1,3,3a,7-tetrazaindene as a stabilizer without providing chemical ripening. This emulsion was a monodispersed emulsion with a cubic crystal form having an average grain size of 0.15 μm.

EXAMPLE 1

The layers were coated on a polyethylene terephthalate film (150 μm) support having a subbing layer (0.5 μm) consisting of a vinylidene chloride copolymer so that the layer structure of UL, EM and PC from the support side was obtained, whereby Samples Nos. 101 to 119 were prepared.

The preparation methods and the coated amounts of the respective layers are shown below.

UL:

There were added gelatin (10 g), polyethyl acrylate of 20 wt % based on the amount of gelatin, and the following Compound (a) of 2 wt % based on the amount of gelatin, and water so that the total quantity was 250 ml, whereby a coating solution was prepared. It was coated so that the gelatin coated amount was 0.2 g/m².

EM:

The above mentioned Emulsion-A was dissolved together with gelatin at 40° C., and then there were added thereto, Dye (S-1) of $3.6\times10^{-4}$ mole per mole of Ag, Dye (S-2) of $1\times10^{-4}$ mole per mole of Ag, Dye (S-3) of $1\times10^{-4}$ mole per mole of Ag, 5-methylbenzotriazole of 6.5 mg/m², 4-hydroxy-1,3,3a,7-tetrazaindene of 1.3 mg/m², 1-phenyl-5-mercaptotetrazole of 1 mg/m², the following Compound (a) of 50 mg/m², polyethyl acrylate of 15 wt % based on the amount of gelatin, a latex copolymer (methyl acrylate:2-acrylamide-2-methylpropanesulfonic acid:2-acetoxyethyl methacrylate=88:5:7) of 0.7 g/m², the following Compound (b) of 4 wt % based on the amount of gelatin, and the hydrazine compound of Formula (III) and the compounds of the present invention represented by Formula (I) and Formula (II) as shown in Table 1. The coating solution thus prepared was applied so that the coated amount of Ag was 3.4 g/m².

Compound (a)

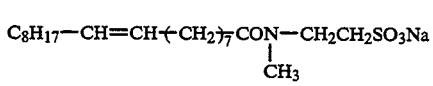

Compound (b)

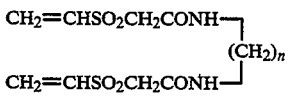

3:1 mixture of n = 2 and n = 3

PC:

A polymethyl methacrylate dispersion (the average particle size: 5μ) and the following Surface Active Agents (a) and (b) were added to a gelatin aqueous solution. The coating solution was applied so that the coated amounts of gelatin and polymethyl methacrylate were 0.5 g/m² and 0.8 g/m², respectively.

Surface Active Agent (a)

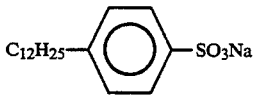

20 mg/m²

Surface Active Agent (b)

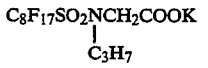

1.5 mg/m²

Further, the back layer of the following composition was coated.

| Composition of the back layer: | |
|---|---|
| Gelatin | 4 g/m² |
| Matting agent | 10 mg/m² |
| polymethyl methacrylate | |
| (particle size: 3.0 to 4.0 μm) | |
| Latex | 2 g/m² |
| polyethyl acrylate | |
| Surface Active Agent (a) | 40 mg/m² |
| Surface Active Agent (b) | 5 mg/m² |
| Gelatin hardener: Compound (b) | 110 mg/m² |
| Dye | |
| a mixture of Dyes (a), (b) and (c) | |
| Dye [a] | 53 mg/m² |
| Dye [b] | 14 mg/m² |
| Dye [c] | 25 mg/m² |

-continued

| Composition of the back layer: | |
|---|---|
| Dye [d] | 18 mg/m$^2$ |

Dye [a]

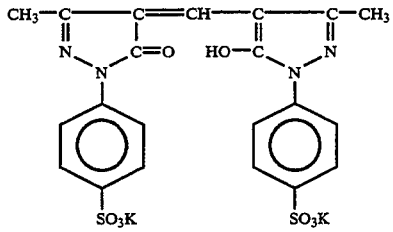

Dye [b]

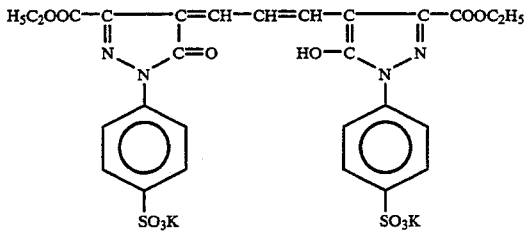

Dye [c]

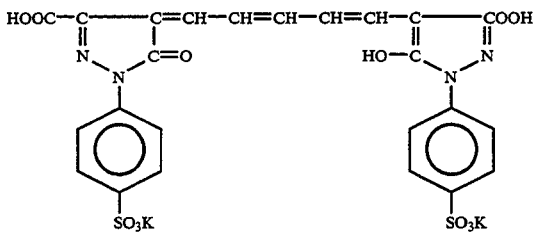

Dye [d]

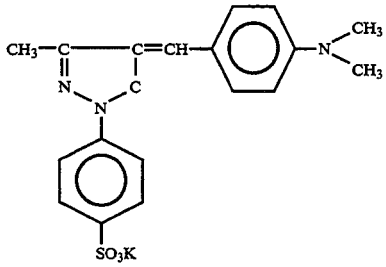

The comparative compounds used in the present example are shown below:

B-1

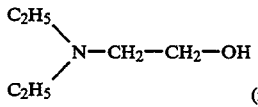

(in JP-A-56-106244)

B-2

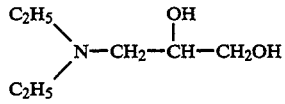

B-3

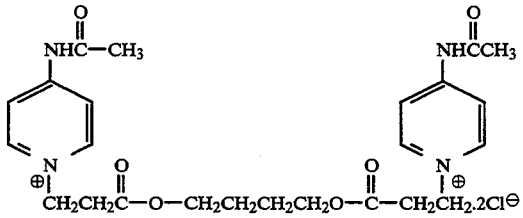

-continued

B-4

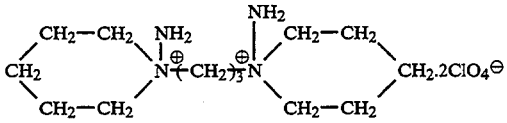

B-5

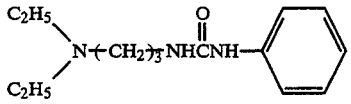

The composition of the developing solution used in the present invention is shown below:

| Composition of the developing solution: | |
|---|---|
| Hydroquinone | 30.0 g |
| N-methyl-p-aminophenol | 0.3 g |
| Sodium hydroxide | 10.0 g |
| Potassium sulfite | 60.0 g |
| Disodium ethylenediaminetetraacetate | 1.0 g |
| Sodium carbonate | 11.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)-benzenesulfonate | 0.2 g |
| Sodium toluenesulfonate | 8.0 g |
| Water was added to | 1 liter (pH 10.5) |

The photographic characteristics are the results obtained by subjecting a light-sensitive material to developing with the automatic developing machine FG-660F (manufactured by Fuji Photo Film Co., Ltd.) in the above mentioned developing solution at 34° C. for 30 seconds, and then to fixing, washing and drying processings. GR-F1 manufactured by Fuji Photo Film Co., Ltd. was used as the fixing solution.

Performance evaluation:

The samples thus prepared were subjected to two kinds of exposures; one was a common sensitometry in which the exposure was carried out with a tungsten light of 3200° K. through an optical wedge; and another was a halftone sensitometry in which the exposure was carried out through an optical wedge and a 150 lines contact screen. The samples of the former exposure were subjected to measurements of sensitivity, gradation and shoulder density.

The sensitivity ($S_{1.5}$) is the value relative to that of the sample containing no compound of Formula (I) nor (II), which is set at 100. Accordingly, the larger value means that the sensitivity is higher.

The gradation ($\gamma$) is the gradient of the line obtained by connecting the point giving an optical density of 0.3 to the point giving an optical density of 3.0 in the characteristic curve. Accordingly, the larger value means that the photographic contrast is higher.

The shoulder density (D1504) is the value of the optical density corresponding to the exposure obtained by adding the exposure of 0.4 in terms of log E to the exposure giving an optical density of 1.5. Accordingly, the larger value means that the shoulder density is higher.

The samples of the latter exposure were subjected to an evaluation of the haltone dot quality.

The haltone dot quality was evaluated by five grades: 5 and 4 mean an excellent quality, 3 means that the quality is not good but a practically usable level, and 2 and 1 are not usable.

TABLE 1

| Sample No. | Compound of Formula (I) or (II) Compound No. | Compound of Formula (I) or (II) Added amount | Compound of Formula (III) Compound No. | Compound of Formula (III) Added amount | Photographic performance $S_{1.5}$ | $\gamma$ | D1504 | Halftone dot quality |
|---|---|---|---|---|---|---|---|---|
| 101 (Comp.) | — | — | — | — | 47 | 7.1 | 4.90 | 2 |
| 102 (Comp.) | — | — | N-46 | $4.0 \times 10^{-5}$ | 100 | 9.0 | 4.20 | 3 |
| 103 (Comp.) | — | — | " | $8.0 \times 10^{-5}$ | 110 | 11.4 | 4.30 | 3 |
| 104 (Inv.) | (A-1) | $2.0 \times 10^{-5}$ | " | $4.0 \times 10^{-5}$ | 114 | 14.8 | 4.96 | 4 |
| 105 (Inv.) | " | $4.0 \times 10^{-5}$ | " | " | 120 | 17.3 | 5.20 | 5 |
| 106 (Inv.) | (A-5) | $1.0 \times 10^{-5}$ | " | " | 135 | 16.8 | 5.11 | 5 |
| 107 (Inv.) | " | $2.0 \times 10^{-5}$ | " | " | 158 | 19.9 | 5.31 | 5 |
| 108 (Inv.) | (A-13) | $1.0 \times 10^{-5}$ | " | " | 135 | 17.2 | 5.24 | 5 |
| 109 (Inv.) | " | $2.0 \times 10^{-5}$ | " | " | 178 | 22.6 | 5.33 | 5 |
| 110 (Comp.) | B-1 | $2.0 \times 10^{-5}$ | " | " | 102 | 9.4 | 4.35 | 3 |
| 111 (Comp.) | " | $4.0 \times 10^{-5}$ | " | " | 105 | 10.0 | 4.45 | 3 |
| 112 (Comp.) | B-2 | $2.0 \times 10^{-5}$ | " | " | 102 | 9.3 | 4.27 | 3 |
| 113 (Comp.) | " | $4.0 \times 10^{-5}$ | " | " | 105 | 9.7 | 4.48 | 3 |
| 114 (Comp.) | B-3 | $2.0 \times 10^{-5}$ | " | " | 105 | 9.6 | 4.45 | 3 |
| 115 (Comp.) | " | $4.0 \times 10^{-5}$ | " | " | 110 | 10.5 | 4.50 | 3 |
| 116 (Comp.) | B-4 | $2.0 \times 10^{-5}$ | " | " | 105 | 9.6 | 4.45 | 3 |
| 117 (Comp.) | " | $4.0 \times 10^{-5}$ | " | " | 110 | 10.6 | 4.57 | 3 |
| 118 (Comp.) | B-5 | $2.0 \times 10^{-5}$ | " | " | 100 | 9.2 | 4.23 | 3 |
| 119 (Comp.) | " | $4.0 \times 10^{-5}$ | " | " | 102 | 9.4 | 4.28 | 3 |

The following can be determined from the results summarized in Table 1. In Sample Nos. 101 and 102, gradation hardness is insufficient, and the halftone dot quality also is inferior. In Sample Nos. 104 to 109 of the present invention, a sufficiently hard gradation is obtained, the shoulder density is high and the halftone dot quality is excellent as well. Meanwhile, in Sample Nos. 110 to 119 in which the comparative amine compounds are used, a sufficiently hard gradation can not be obtained, the density is low, and the halftone dot quality is also inferior. It can be found that they are clearly inferior to those of the present invention.

EXAMPLE 2

Sample Nos. 201 to 219 were prepared in the same manner as those in Example 1, except that the sensitizing dye contained in EM of Example 1 was replaced with 5,5'-dichloro-9-ethyl-3,3'-bis-(3-sulfopropylloxacarbocyanine) $4 \times 10^{-4}$ mole/mole Ag and the amount of Dye (S-4) was changed to $4 \times 10^{-4}$ mole/mole Ag and that the hydrazine compounds of Formula (III) and the compounds of the present invention represented by Formula (I) and Formula (II) were added as shown in Table 2. The performance evaluations were carried out in the same manner as those in Example 1.

TABLE 2

| Sample No. | Compound of Formula (I) or (II) Compound No. | Compound of Formula (I) or (II) Added amount | Compound of Formula (III) Compound No. | Compound of Formula (III) Added amount | Photographic performance $S_{1.5}$ | $\gamma$ | D1504 | Halftone dot quality |
|---|---|---|---|---|---|---|---|---|
| 201 (Comp.) | — | — | — | — | 76 | 6.6 | 4.00 | 2 |
| 202 (Comp.) | — | — | N-60 | $5.0 \times 10^{-5}$ | 100 | 8.4 | 4.12 | 3 |
| 203 (Comp.) | — | — | " | $1.0 \times 10^{-4}$ | 110 | 9.7 | 4.26 | 3 |
| 204 (Inv.) | (A-1) | $2.0 \times 10^{-5}$ | " | $5.0 \times 10^{-5}$ | 114 | 13.9 | 4.70 | 4 |
| 205 (Inv.) | " | $4.0 \times 10^{-5}$ | " | " | 117 | 16.5 | 4.89 | 5 |
| 206 (Inv.) | (A-13) | $1.0 \times 10^{-5}$ | " | " | 126 | 17.3 | 5.18 | 5 |
| 207 (Inv.) | " | $2.0 \times 10^{-5}$ | " | " | 170 | 20.0 | 5.31 | 5 |
| 208 (Inv.) | B-2 | $2.0 \times 10^{-5}$ | " | " | 102 | 8.5 | 4.15 | 3 |
| 209 (Comp.) | " | $4.0 \times 10^{-5}$ | " | " | 105 | 8.7 | 4.14 | 3 |
| 210 (Comp.) | B-3 | $2.0 \times 10^{-5}$ | " | " | 105 | 8.7 | 4.17 | 3 |
| 211 (Comp.) | " | $4.0 \times 10^{-5}$ | " | " | 107 | 9.1 | 4.20 | 3 |
| 212 (Comp.) | B-5 | $2.0 \times 10^{-5}$ | " | " | 100 | 8.6 | 4.26 | 3 |
| 213 (Comp.) | " | $4.0 \times 10^{-5}$ | " | " | 102 | 8.8 | 4.31 | 3 |
| 214 (Comp.) | — | — | N-41 | $5.0 \times 10^{-5}$ | 93 | 7.0 | 3.95 | 3 |
| 215 (Comp.) | (A-11) | $2.0 \times 10^{-5}$ | " | " | 135 | 19.5 | 5.22 | 5 |
| 216 (Inv.) | " | $4.0 \times 10^{-5}$ | " | " | 173 | 21.8 | 5.35 | 5 |
| 217 (Inv.) | " | — | N-14 | $1.0 \times 10^{-5}$ | 84 | 7.3 | 4.15 | 3 |
| 218 (Comp.) | (A-5) | $2.0 \times 10^{-5}$ | " | " | 117 | 15.9 | 4.99 | 5 |
| 219 (Inv.) | " | $4.0 \times 10^{-5}$ | " | " | 141 | 19.3 | 5.21 | 5 |

It can be determined from the results summarized in Table 2 that in the present invention, high sensitivity, hard gradation and high density are achieved and that halftone dot quality is excellent as well.

EXAMPLE 3

The samples were prepared in the same manner as those in Example 1, except that the emulsion used in EM of Example 1 was replaced with Emulsion B and that the hydrazine derivatives and the compounds of Formula (I) and Formula (II) were changed as shown in Table 3. The performance evaluations were carried out as well in the same manner as those in Example 1.

TABLE 3

| Sample No. | Compound of Formula (I) or (II) Compound No. | Compound of Formula (I) or (II) Added amount | Compound of Formula (III) Compound No. | Compound of Formula (III) Added amount | Photographic performance $S_{1.5}$ | $\gamma$ | D1504 | Halftone dot quality |
|---|---|---|---|---|---|---|---|---|
| 301 (Comp.) | — | — | — | — | 71 | 6.3 | 3.95 | 2 |
| 302 (Comp.) | — | — | N-61 | $3.0 \times 10^{-5}$ | 100 | 12.5 | 4.31 | 3 |
| 303 (Comp.) | — | — | " | $6.0 \times 10^{-5}$ | 141 | 10.1 | 4.55 | 2 |
| 304 (Inv.) | (A-2) | $2.5 \times 10^{-5}$ | " | $3.0 \times 10^{-5}$ | 117 | 15.2 | 4.88 | 5 |
| 305 (Inv.) | " | $5.0 \times 10^{-5}$ | " | " | 126 | 17.7 | 5.03 | 5 |
| 306 (Inv.) | (A-7) | $2.5 \times 10^{-5}$ | " | " | 123 | 16.7 | 5.00 | 5 |
| 307 (Inv.) | " | $5.0 \times 10^{-5}$ | " | " | 141 | 21.6 | 5.33 | 5 |
| 308 (Inv.) | (A-10) | $2.5 \times 10^{-5}$ | " | " | 115 | 15.5 | 4.89 | 4 |
| 309 (Inv.) | " | $5.0 \times 10^{-5}$ | " | " | 132 | 17.5 | 5.11 | 5 |
| 310 (Inv) | (A-12) | $1.2 \times 10^{-5}$ | " | " | 126 | 17.1 | 5.11 | 5 |
| 311 (Inv.) | " | $2.5 \times 10^{-5}$ | " | " | 162 | 22.4 | 5.31 | 5 |
| 312 (Comp) | B-2 | $2.5 \times 10^{-5}$ | " | " | 102 | 13.1 | 4.35 | 3 |
| 313 (Comp.) | " | $5.0 \times 10^{-5}$ | " | " | 107 | 13.5 | 4.39 | 3 |
| 314 (Comp.) | B-3 | $2.5 \times 10^{-5}$ | " | " | 105 | 13.7 | 4.39 | 3 |
| 315 (Comp.) | " | $5.0 \times 10^{-5}$ | " | " | 110 | 14.0 | 4.45 | 3 |
| 316 (Comp.) | — | — | N-27 | $1.5 \times 10^{-5}$ | 100 | 10.3 | 4.62 | 3 |
| 317 (Inv.) | (A-2) | $2.5 \times 10^{-5}$ | " | " | 112 | 17.3 | 5.21 | 5 |
| 318 (Inv.) | — | $5.0 \times 10^{-5}$ | " | " | 123 | 19.5 | 5.25 | 5 |

It is apparent from the results summarized in Table 3 that in the samples of the present invention, high sensitivity, hard gradation and high density are achieved and that the halftone dot quality is excellent as well.

EXAMPLE 4

The samples were prepared in the same manner as those in Example 1, except that the sensitizing dye contained in EM was replaced with Dyes (S-5) and (S-6) each of $1 \times 10^{-5}$ mole/mole Ag and that the hydrazine derivatives and the compounds of Formula (I) and Formula (II) were changed as shown in Table 4. The performance evaluations were carried out as well in the same manner as those in Example 1.

TABLE 4

| Sample No. | Compound of Formula (I) or (II) Compound No. | Compound of Formula (I) or (II) Added amount | Compound of Formula (III) Compound No. | Compound of Formula (III) Added amount | Photographic performance $S_{1.5}$ | $\gamma$ | D1504 | Halftone dot quality |
|---|---|---|---|---|---|---|---|---|
| 401 (Comp.) | — | — | — | — | 78 | 6.8 | 4.30 | 2 |
| 402 (Comp.) | — | — | N-46 | $3.5 \times 10^{-5}$ | 100 | 8.3 | 4.51 | 3 |
| 403 (Comp.) | — | — | " | $7.0 \times 10^{-5}$ | 117 | 9.9 | 4.70 | 3 |
| 404 (Inv.) | (A-1) | $2.2 \times 10^{-5}$ | " | $3.5 \times 10^{-5}$ | 123 | 12.8 | 4.99 | 5 |
| 405 (Inv.) | " | $4.4 \times 10^{-5}$ | " | " | 129 | 14.7 | 5.16 | 5 |
| 406 (Inv.) | (A-5) | $1.1 \times 10^{-5}$ | " | " | 132 | 17.4 | 5.22 | 5 |
| 407 (Inv.) | " | $2.2 \times 10^{-5}$ | " | " | 158 | 20.2 | 5.32 | 5 |
| 408 (Inv.) | (A-13) | $1.1 \times 10^{-5}$ | " | " | 141 | 18.9 | 5.25 | 5 |
| 409 (Inv.) | " | $2.2 \times 10^{-5}$ | " | " | 186 | 22.4 | 5.35 | 5 |
| 410 (Comp.) | B-1 | $2.2 \times 10^{-5}$ | " | " | 100 | 8.3 | 4.61 | 3 |
| 411 (Comp.) | " | $4.4 \times 10^{-5}$ | " | " | 102 | 8.7 | 4.63 | 3 |
| 412 (Comp.) | B-3 | $2.2 \times 10^{-5}$ | " | " | 107 | 9.5 | 4.71 | 3 |
| 413 (Comp.) | " | $4.4 \times 10^{-5}$ | " | " | 112 | 10.7 | 4.75 | 3 |
| 414 (Comp.) | B-4 | $2.2 \times 10^{-5}$ | " | " | 100 | 8.5 | 4.55 | 3 |
| 415 (Comp.) | " | $4.4 \times 10^{-5}$ | " | " | 105 | 9.1 | 4.70 | 3 |

It can be determined from the results summarized in Table 4 that the samples of the present invention provide high sensitivity, hard gradation, high density and an excellent halftone dot quality while Sample Nos. 410 to 415 in which the comparative compounds B-1, B-3 and B-4 are used can not provide a sufficiently hard gradation and give a low D1504 as well as an insufficient halftone dot quality.

The samples of the present invention were exposed with a Xenon light source via an interference filter of 633 nm for $10^{-4}$ and $10^{-6}$ seconds to evaluate their photographic performance. The results thereof showed that the samples of the present invention provide excellent performance similarly to the results shown in Table 4.

EXAMPLE 5

EM and PC were coated in this order from a support side on a polyethylene terephthalate film (150 μm) support having a subbing layer consisting of a vinylidene chloride copolymer, whereby the samples were prepared.

The preparation manner and coated amounts of the respective layers are shown below.

EM:

The above mentioned Emulsion-C was dissolved at 40° C., and then the hydrazine compounds of Formula (III) and the compounds of the present invention represented by Formula (I) and Formula (II) were added thereto as shown in Table 5. Further added were the following Compound 1 of 2.6 mg/m$^2$, a latex copolymer (methyl acrylate:2-acrylamido-2-methylpropanesulfonic acid:2-acetoxy-ethyl methacrylate=88:5:7) of 0.7 g/m$^2$, polyethyl acrylate (15 wt % based on the amount of gelatin), and 1,3-divinylsulfonyl-2-propanol (35 wt % based on the amount of gelatin). The coating solution thus prepared was applied so that the coated amount of Ag was 3.4 g/m$^2$.

PC:

There were coated gelatin of 13 g/m$^2$, thioctic acid of 2.1 mg/m$^2$, the following solid matter dispersing Dyes D-1 and D-2 each of 50 mg/m$^2$, polymethyl methacrylate (an average particle size: 2.5 μm) of 9.0 mg/m$^2$ as a matting agent, silica (an average particle size: 4.0 μm) of 9.0 mg/m$^2$, and Compound (a) of 37 mg/m$^2$ and Compound (b) of 2.5 mg/m$^2$ each used in the preceding example as a surface active agent.

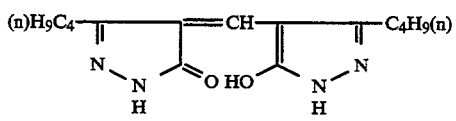

D-1

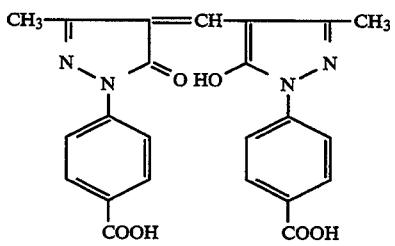

D-2

Performance evaluation:

The above coated samples were subjected to an imagewise exposure with the daylight printer P-627FM manufactured by Dainippon Screen Co., Ltd. through the originals shown in Figure. The exposed samples were subjected to development processing in the same manner as in Example 1 in the same developing solution as that used in Example 1. The loose character image quality of these samples was checked. Further, the samples were subjected to exposure with the above P-627FM via an optical wedge and to development processing in the same manner as that mentioned above to check $S_{1.5}$, γ and D1504.

The loose character image quality 5 means the image quality in which the character with a 30 μm width is reproduced when an optimum exposure is given with the originals shown in Figure so that a halftone dot area of 50% becomes a halftone dot area of 50% on a contact light-sensitive material for a dot to dot work, and it shows a very good loose character image quality. Meanwhile, the loose character image quality 1 means the image quality in which when an optimum exposure is similarly given, only the character with a 150 μm width can be reproduced, and it is an inferior loose character image quality. The ranks of 2 to 4 were put between 5 and 1 by a visual observation. The rank of 3 or higher is a usable level.

The results are shown in Table 5. The samples of the present invention have the excellent loose character image quality.

TABLE 5

| Sample No. | Compound of Formula (I) or (II) Compound No. | Compound of Formula (I) or (II) Added amount | Compound of Formula (III) Compound No. | Compound of Formula (III) Added amount | Photographic performance $S_{1.5}$ | γ | D1504 | Halftone dot quality |
|---|---|---|---|---|---|---|---|---|
| 501 (Comp.) | — | — | — | — | 79 | 7.8 | 4.09 | 2 |
| 502 (Comp.) | — | — | N-26 | $8.0 \times 10^{-5}$ | 100 | 8.5 | 4.35 | 3 |
| 503 (Comp.) | — | — | " | $1.6 \times 10^{-4}$ | 112 | 9.7 | 4.53 | 3 |
| 504 (Inv.) | (A-1) | $2.0 \times 10^{-5}$ | " | $8.0 \times 10^{-5}$ | 112 | 10.7 | 4.80 | 4 |
| 505 (Inv.) | " | $4.0 \times 10^{-5}$ | " | " | 125 | 12.4 | 4.99 | 4 |
| 506 (Inv.) | (A-5) | $2.0 \times 10^{-5}$ | " | " | 120 | 15.8 | 5.09 | 5 |
| 507 (Inv.) | " | $4.0 \times 10^{-5}$ | " | " | 145 | 20.5 | 5.15 | 5 |
| 508 (Inv.) | (A-13) | $2.0 \times 10^{-5}$ | " | " | 125 | 17.7 | 5.08 | 5 |
| 509 (Inv.) | " | $4.0 \times 10^{-5}$ | " | " | 158 | 23.7 | 5.17 | 5 |
| 510 (Comp.) | B-1 | $2.0 \times 10^{-5}$ | " | " | 100 | 8.4 | 4.35 | 3 |
| 511 (Comp.) | " | $4.0 \times 10^{-5}$ | " | " | 102 | 8.7 | 4.37 | 3 |
| 512 (Comp.) | B-2 | $2.0 \times 10^{-5}$ | " | " | 100 | 8.5 | 4.31 | 3 |
| 513 (Comp.) | " | $4.0 \times 10^{-5}$ | " | " | 102 | 8.7 | 4.39 | 3 |
| 514 (Comp.) | B-3 | $2.0 \times 10^{-5}$ | " | " | 105 | 8.9 | 4.41 | 3 |
| 515 (Comp.) | " | $4.0 \times 10^{-5}$ | " | " | 110 | 9.3 | 4.55 | 3 |
| 516 (Comp.) | B-4 | $2.0 \times 10^{-5}$ | " | " | 100 | 8.5 | 4.35 | 3 |
| 517 (Comp.) | " | $4.0 \times 10^{-5}$ | " | " | 100 | 8.4 | 4.37 | 3 |
| 518 (Comp.) | B-5 | $2.0 \times 10^{-5}$ | " | " | 100 | 8.6 | 4.37 | 3 |
| 519 (Comp.) | " | $4.0 \times 10^{-5}$ | " | " | 102 | 8.7 | 4.35 | 3 |

It can be determined from the results summarized in Table 5 that in the comparative samples, the increase in the addition amount of the hydrazine compound by two times can not provide a sufficiently hard gradation. Meanwhile, Sample Nos. 504 to 509 of the present invention provide a sufficiently hard gradation, a high sensitivity and an excellent halftone dot quality.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive material containing at least one compound represented by the following Formula (I) or (II):

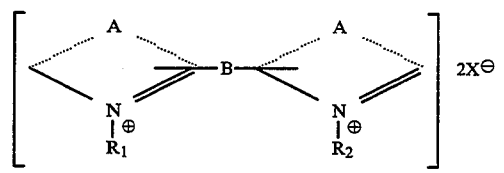

(I)

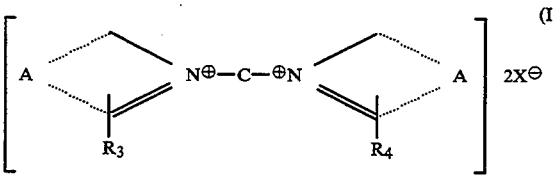

(II)

wherein A represents an organic group necessary for completing a hetero ring; B and C each represents a group constituted of one or more members selected from the group consisting of an alkylene group, an arylene group, an alkenylene group, —$SO_2$—, —SO—, —O—, —S—, and —N($R_5$)—, where $R_5$ represents an alkyl group, an aryl group, or a hydrogen atom; $R_1$ and $R_2$ each represents an alkyl group; $R_3$ and $R_4$ each represents a substituent which is selected from the group consisting of a halogen atom, an unsubstituted alkyl group, an aryl-substituted alkyl group, a hydroxy alkyl group, an unsubstituted aryl group, an alkyl- or halogen-substituted aryl group, an unsubstituted acyl group, a halogen-substituted phenyl group, an alkyl-substituted acyl group, a sulfo group, a carboxy group, a hydroxy group, an alkoxy group, an aryloxy group, an amide group, a sulfamoyl group, a carbamoyl group, a ureido group, an unsubstituted or alkyl-substituted amino group, a cyano group, a nitro group, an alkylthio group and an arylthio group; and X represents an anion group, provided that X is not necessary when the compound is an inner salt.

2. The silver halide light-sensitive material of claim 1, wherein the material further comprises a support having provided thereon at least one silver halide emulsion layer and a hydrazine derivative located in the emulsion layer or in a layer adjacent thereto or in the emulsion layer and in the layer adjacent thereto.

3. The silver halide light-sensitive material of claim 1, wherein the material contains a compound represented by Formula (I).

4. The silver halide light-sensitive material of claim 3, wherein A forms a pyridine ring.

5. The silver halide light-sensitive material of claim 3, wherein B represents a group constituted by one or more members selected from the group consisting of an alkylene group, an arylene group, —O—, —S— and divalent group formed by combination of these groups.

6. The silver halide light-sensitive material of claim 3, wherein $R_1$ and $R_2$ each represents an alkyl group having 1 to 10 carbon atoms.

7. The silver halide light-sensitive material of claim 1, wherein the material contains a compound represented by Formula (II).

8. The silver halide light-sensitive material of claim 7, wherein A forms a pyridine ring.

9. The silver halide light-sensitive material of claim 7, wherein C represents a group constituted by one or more members selected from the group consisting of an alkylene group, an arylene group, —O— and —S—, and di-valent group formed by combination of these groups.

10. The silver halide light-sensitive material of claim 7, wherein $R_3$ and $R_4$ each represents a halogen atom, a sulfo group, a carboxy group, a hydroxy group, an alkoxy group, an aryloxy group, an amide group, a sulfamoyl group, a carbamoyl group, a ureido group, an amino group, an alkyl substituted amino group, a cyano group, a nitro group, an alkylthio group, an arylthio group, or an aryl substituted alkyl group.

11. The silver halide light-sensitive material of claim 10, wherein $R_3$ and $R_4$ is each an aryl-substituted alkyl group.

12. The silver halide light-sensitive material of claim 2, wherein the hydrazine derivative is represented by the following Formula (III):

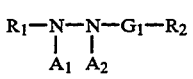

(III)

wherein $R_1$ represents an aliphatic group, an aromatic group, or a heterocyclic group and may or may not be substituted; $R_2$ represents a hydrogen atom, an alkyl group, an aryl group, an alkoxy group, an aryloxy group, an amino group, or a hydrazino group, and the groups other than the hydrogen atom may or may not be substituted; $G_1$ represents a carbonyl group, a sulfonyl group, a sulfoxy group, —P(O)($R_3$)— (where $R_3$ is selected from the same substituents as those defined for $R_2$), —C(O)C(O)—, a thiocarbonyl group, or an iminomethylene group; both $A_1$ and $A_2$ represent a hydrogen atom, or either of them represents a hydrogen atom and the other represents a substituted or unsubstituted alkylsulfonyl group, a substituted or unsubstituted arylsulfonyl, or a substituted or unsubstituted acyl group.

13. A method for forming an image with a silver halide light-sensitive material which comprises imagewise exposing and developing the silver halide light-sensitive material using a developing solution having pH of 9.6 to 11.0, in which the silver halide light-sensitive material comprises at least one compound represented by Formula (I) or (II):

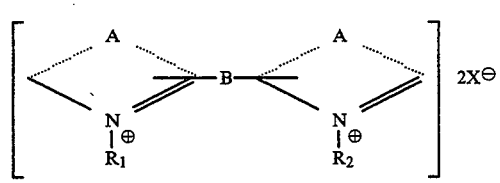

(I)

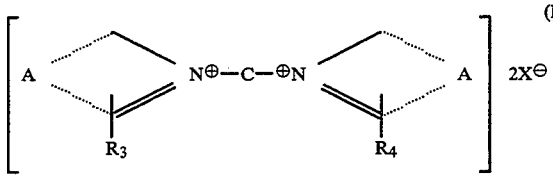

(II)

wherein A represents an organic group necessary for completing hetero ring; B and C each represents a group constituted of one or more members selected from the group consisting of an alkylene group, an arylene group, an alkenylene group, —$SO_2$—, —SO—, —O—, —S—, and —N($R_5$)—, where $R_5$ represents an alkyl group, an aryl group, or a hydrogen atom; $R_1$ and $R_2$ each represents an alkyl group; $R_3$ and $R_4$ each represents a substituent which is selected from the group consisting of a halogen atom, an unsubstituted alkyl group, a hydroxy alkyl group, an aryl substituted alkyl group, an unsubstituted aryl group, an alkyl- or halogen-substituted aryl group, an unsubstituted acyl group, a halogen-substituted phenyl group, an alkyl-substituted acyl group, a sulfo group, a carboxy group, a hydroxy group, an alkoxy group, an aryloxy group, an amide group, a sulfamoyl group, a carbamoyl group, a ureido group, an unsubstituted or alkyl-substituted amino group, a cyano group, a nitro group, an alkylthio group and an arylthio group; and X represents an anion group, provided that X is not necessary when the compound is an inner salt.

14. The method for forming an image with a silver halide light-sensitive material of claim 13, wherein the material further comprises a support having provided thereon at least one silver halide emulsion layer and a hydrazine derivative located in the emulsion layer or in a layer adjacent thereto or in the emulsion layer and in the layer adjacent thereto.

15. The method for forming an image with a silver halide light-sensitive material of claim 13, wherein the material contains a compound represented by Formula (I).

16. The method for forming an image with a silver halide light-sensitive material of claim 15, wherein A forms a pyridine ring.

17. The method for forming an image with a silver halide light-sensitive material of claim 15, wherein B represents a group constituted by one or more members selected from the group consisting of an alkylene group, an arylene group, —O—, —S— and a divalent group formed by combination of these groups.

18. The method for forming an image with a silver halide light-sensitive material of claim 15, wherein $R_1$ and $R_2$ each represents an alkyl group having 1 to 10 carbon atoms.

19. The method for forming an image with a silver halide light-sensitive material of claim 13, wherein the material contains a compound represented by Formula (II).

20. The method for forming an image with a silver halide light-sensitive material of claim 19, wherein A forms a pyridine ring.

21. The method for forming an image with a silver halide light-sensitive material of claim 19, wherein C represents a group constituted by one or more members selected from the group consisting of an alkylene group, an arylene group, —O— and —S—, and a divalent group formed by combination of these groups.

22. The method for forming an image with a silver halide light-sensitive material of claim 19, wherein $R_3$ and $R_4$ each represents a halogen atom, a sulfo group, a carboxy group, a hydroxy group, an alkoxy group, an aryloxy group, an amide group, a sulfamoyl group, a carbamoyl group, a ureido group, an amino group, an alkyl substituted amino group, a cyano group, a nitro group, an alkylthio group, an arylthio group, or an aryl substituted alkyl group.

23. The method for forming an image with a silver halide light-sensitive material of claim 22, wherein $R_3$ and $R_4$ is each an aryl-substituted alkyl group.

24. The method for forming an image with a silver halide light-sensitive material of claim 14, wherein the hydrazine derivative is represented by the following Formula (III):

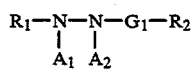

$$R_1-\underset{\underset{A_1}{|}}{N}-\underset{\underset{A_2}{|}}{N}-G_1-R_2 \qquad \text{(III)}$$

wherein $R_1$ represents an aliphatic group, an aromatic group, or a heterocyclic group and may or may not be substituted; $R_2$ represents a hydrogen atom, an alkyl group, an aryl group, an alkoxy group, an aryloxy group, an amino group, or a hydrazino group, and the groups other than the hydrogen atom may or may not be substituted; $G_1$ represents a carbonyl group, a sulfonyl group, a sulfoxy group, —P(O)($R_3$)— (where $R_3$is selected from the same substituents as those defined for $R_2$), —C(O)C(O)—, a thiocarbonyl group, or an iminomethylene group; both $A_1$ and $A_2$ represent a hydrogen atom, or either of them represents a hydrogen atom and the other represents a substituted or unsubstituted alkylsulfonyl group, a substituted or unsubstituted arylsulfonyl, or a substituted or unsubstituted acyl group.

* * * * *